US007184675B2

(12) United States Patent
Shiraishi

(10) Patent No.: US 7,184,675 B2
(45) Date of Patent: Feb. 27, 2007

(54) FIXING TEMPERATURE CONTROL METHOD AND IMAGE FORMING APPARATUS WITH DETECTION OF THICKNESS OF A PRINT MEDIUM

(75) Inventor: Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 244 days.

(21) Appl. No.: 10/874,290

(22) Filed: Jun. 24, 2004

(65) Prior Publication Data

US 2004/0264992 A1 Dec. 30, 2004

(30) Foreign Application Priority Data

Jun. 25, 2003 (JP) ..... 2003-180387
Jan. 27, 2004 (JP) ..... 2004-018068

(51) Int. Cl.
*G03G 15/00* (2006.01)

(52) U.S. Cl. ..... 399/45; 399/69

(58) Field of Classification Search ..... 399/43, 399/44, 67, 69, 389, 45; 219/216
See application file for complete search history.

(56) References Cited

U.S. PATENT DOCUMENTS 4,835,573 A * 5/1989 Rohrer et al. ..... 399/23
5,282,001 A * 1/1994 Watson ..... 399/46
5,512,992 A * 4/1996 Kim et al. ..... 399/69
5,831,744 A * 11/1998 Kataoka ..... 358/296
6,804,478 B2 * 10/2004 Martin et al. ..... 399/45
6,850,717 B2 * 2/2005 Fujikura et al. ..... 399/45

FOREIGN PATENT DOCUMENTS

JP 01300283 A * 12/1989
JP 10-171192 6/1998
JP 2001056621 A * 2/2001
JP 2003285484 A * 10/2003

* cited by examiner

*Primary Examiner*—Robert Beatty
(74) *Attorney, Agent, or Firm*—Rabin & Berdo, P.C.

(57) ABSTRACT

In an image forming apparatus which has a medium thickness detecting unit for detecting a thickness of print medium and forms an image by an electrophotographic process, the apparatus has a unit for detecting the thickness of print medium that is used after a predetermined operation and a unit for detecting the thicknesses of print media on a paper feed tray at a period of a predetermined number of print pages. A target temperature of a fixing device is set on the basis of the thickness of print medium that is used after the predetermined operation and the thicknesses of print media detected at the period of the predetermined number of print pages. A waiting time is reduced and print quality can be maintained by this apparatus.

19 Claims, 13 Drawing Sheets

*Fig.2* PRIOR ART
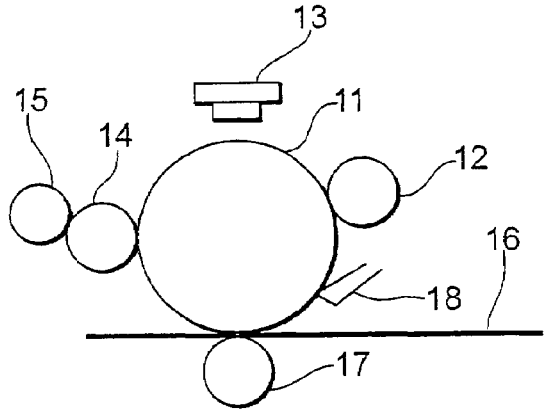
*Fig.3* PRIOR ART
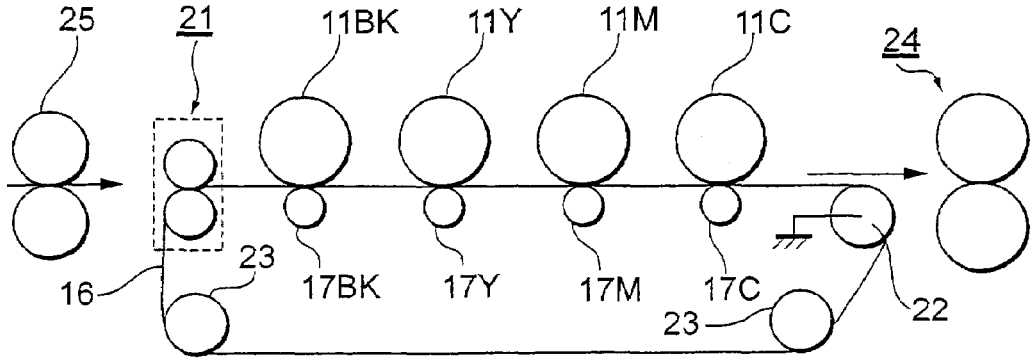

*Fig. 8*

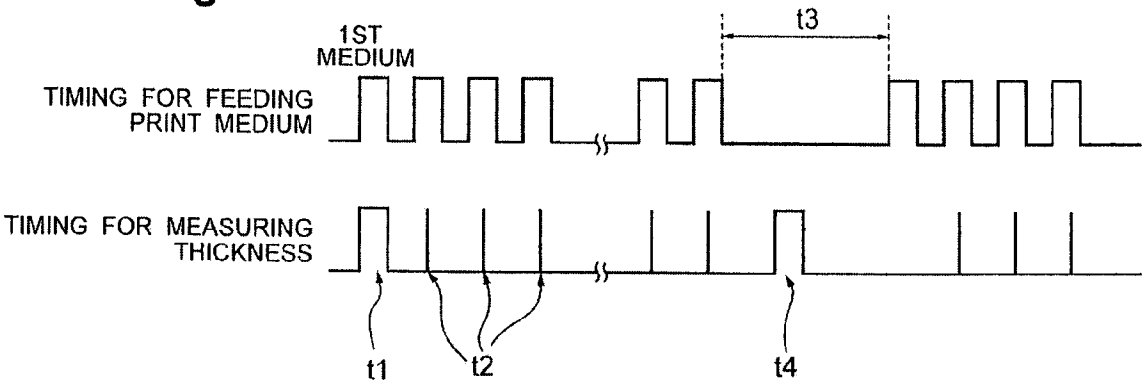

*Fig. 9*

| | CASE 1 | CASE 1 | CASE 3 |
|---|---|---|---|
| 1ST MEDIUM | DETECTION OF THICK PAPER | DETECTION OF THICK PAPER | DETECTION OF THICK PAPER |
| 2ND MEDIUM | DETECTION OF THICK PAPER | DETECTION OF PLAIN PAPER | DETECTION OF PLAIN PAPER |
| 3RD MEDIUM | OPERATE IN THICK PAPER MODE | DETECTION OF THICK PAPER | DETECTION OF PLAIN PAPER |
| 4TH MEDIUM | OPERATE IN THICK PAPER MODE | OPERATE IN THICK PAPER MODE | OPERATE IN PLAIN PAPER MODE |

FIXING TEMPERATURE CONTROL METHOD AND IMAGE FORMING APPARATUS WITH DETECTION OF THICKNESS OF A PRINT MEDIUM

BACKGROUND OF THE INVENTION

1. Field of the Invention

The invention relates to a fixing temperature control method and an image forming apparatus.

2. Related Background Art

Hitherto, in image forming apparatuses such as printer of an electrophotographic system, copying apparatus, and the like, an image is formed onto a print medium such as paper or the like by electrophotographic processes which are executed in order of a charging process for accumulating charges on a photosensitive drum, an exposing process for irradiating light to a position where image data exists, a developing process for depositing a toner image onto the exposed portion, a transfer process for transferring developed toner onto the print medium, and a fixing process for fixing the toner image on the print medium by heat and pressure (for example, refer to JP-A-10-171192).

FIG. 2 is a diagram showing a construction of the conventional image forming apparatus.

In the diagram, reference numeral 11 denotes a photosensitive drum as an image holding material; 12 a charging roller as a charging apparatus which is arranged around the photosensitive drum 11 and supplies charges onto a surface of the photosensitive drum 11; 13 an exposing apparatus which selectively irradiates light onto the charged surface of the photosensitive drum 11 and forms an electrostatic latent image; 14 a developing roller which deposits toner onto the surface of the photosensitive drum 11 on which the electrostatic latent image has been formed and develops the deposited toner; 15 a toner supplying roller which supplies the toner to the developing roller 14; 16 a transfer belt which conveys the print medium such as paper or the like; 17 a transfer roller which is arranged so as to face the photosensitive drum 11 and transfers the toner image onto the print medium conveyed by the transfer belt 16; and 18 a cleaning blade as a cleaning apparatus which removes the toner remaining on the surface of the photosensitive drum 11.

In the image forming apparatus with such a construction, the charging process for accumulating the charges on the photosensitive drum 11 is executed by the charging roller 12, the exposing process for irradiating the light to the image data forming position on the photosensitive drum 11 is executed by the exposing apparatus 13, the developing process for depositing the toner onto the exposed portion is executed by the developing roller 14, and the transfer process for transferring the developed toner onto the print medium is executed by the transfer roller 17. The fixing process for fixing the toner image on the print medium by the heat and pressure is executed by a fixing device (not shown).

In a color image forming apparatus such as a color electrophotographic printer of a tandem type or the like, drum units of four colors (black, yellow, magenta, and cyan) are arranged and an image of each color is overlaid one by one, thereby forming a final image.

FIG. 3 is a diagram showing a construction of the conventional color image forming apparatus.

In FIG. 3, reference numeral 11BK denotes a photosensitive drum in a drum unit of black; 11Y a photosensitive drum in a drum unit of yellow; 11M a photosensitive drum in a drum unit of magenta; 11C a photosensitive drum in a drum unit of cyan; 17BK a transfer roller in the drum unit of black; 17Y a transfer roller in the drum unit of yellow; 17M a transfer roller in the drum unit of magenta; and 17C a transfer roller in the drum unit of cyan. Each drum unit is constructed as shown in FIG. 2.

Reference numeral 21 denotes an adsorbing portion; 22 a driving roller; 23 an idle roller; 24 a fixing device; and 25 a resist roller.

In the image forming apparatus with such a construction, prior to entering a printing process, a thickness of print medium is measured and process values suitable for the thickness of print medium are determined. In this case, for example, the image forming apparatus has a table of a transfer voltage, a developing voltage, a fixing temperature, and the like which have previously been formed in accordance with the thickness of print medium. The image forming apparatus measures the thickness of print medium and determines the process values such as transfer voltage, developing voltage, fixing temperature, and the like with reference to the table. The thickness of print medium is measured each time the print medium is fed or the thickness of only the first one of the print media stacked on a paper feed tray is measured.

However, in the above conventional image forming apparatus, a throughput of the image forming apparatus deteriorates because of necessity of a waiting time and an inconvenience such as defective image, defective fixing, wrapping, or the like occurs.

That is, the thickness of each print medium is slightly different even in the same kind of print media. Therefore, in the case where the thickness is measured each time the print medium is fed and the process values suitable for the thickness of print medium are decided, it is necessary to take control for increasing or decreasing the transfer voltage, developing voltage, fixing temperature, and the like every print medium. In this case, since it takes time to change the fixing temperature, the waiting time is necessary and the throughput of the image forming apparatus deteriorates.

Therefore, the method of measuring the thickness of only the first one of the print media stacked on the paper feed tray has also been proposed. Since the print media of the same thickness are ordinarily stacked on the paper feed tray, the thickness of the first print medium is almost equal to that of the residual print media. Therefore, there is no need to change the process values such as a fixing temperature and the like. Consequently, there is no need to change the fixing temperature and the like every print medium, the waiting time is unnecessary, and the throughput of the image forming apparatus does not deteriorate.

However, there is a case of presuming a thickness that is largely different from that of the actual print medium due to output errors of sensors, a variation in pages of the print media, or the like. If the process values such as a fixing temperature and the like are determined on the basis of the wrong thickness, the inconvenience such as defective image, defective fixing, wrapping, or the like occurs.

For example, when printing of a high density is performed to a print medium such as thin paper, if a proper fixing temperature is not set, the print medium is likely to be wrapped around the fixing device and the roller will be damaged or broken at worst.

SUMMARY OF THE INVENTION

It is an object of the invention to provide a fixing temperature control method and an image forming apparatus, by which the above conventional problems can be solved, the waiting time can be shortened as much as possible, and print quality can be maintained.

According to the present invention, there is provided a fixing temperature control method in an image forming apparatus which has medium thickness detecting means for detecting a thickness of print medium and forms an image by an electrophotographic process, wherein the image forming apparatus comprises means which detects the thickness of the print medium that is used after a predetermined operation and means which detects thicknesses of print media at a predetermined print period, and a target temperature of a fixing device is set on the basis of the thickness of the print medium that is used after the predetermined operation and the thicknesses of the print media detected at the predetermined print period.

In the method, the predetermined operation is an operation to attach a paper feed tray to the image forming apparatus.

Further, In the method, the image forming apparatus has a plurality of paper feed trays, the predetermined operation is an operation to change the paper feed trays which are used.

Further, in the method, the predetermined print period is set on the basis of the number of print pages.

Further, in the method, the predetermined print period is set on the basis of the number of rotations of a photosensitive drum.

Further, in the method, a setting of the predetermined print period can be changed.

Further, in the method, the target temperature of the fixing device is set in accordance with an average value of the detected thickness of the print medium and the previously detected thickness of the print medium.

Further, in the method, the image forming apparatus further has means which detects the thickness of the print medium every page, and when a difference between the thickness of the print medium detected every page and the thickness of the print medium serving as a reference upon setting of the fixing temperature is equal to or larger than a predetermined value, the print medium is ejected without forming the image.

Further, in the method,the target temperature of the fixing device is not changed until a print job is finished.

Further, in the method, the target temperature of the fixing device is set on the basis of the detected thicknesses of a plurality of print media. In this case, the target temperature of the fixing device may be set by majority decision of ranks of the detected thicknesses of a plurality of print media, also the target temperature of the fixing device may be set on the basis of an average value of the detected thicknesses of a plurality of print media.

Further, in the method, a threshold value of the thickness of the print medium which is used for switching the target temperature of the fixing device to a low temperature and a threshold value of the thickness of the print medium which is used for switching the target temperature of the fixing device to a high temperature are different.

Further, in the method, an average value of the thickness of the print medium serving as a reference upon setting of the fixing temperature and the detected thickness of the print medium is calculated;

when a difference between the average value and the thickness of the print medium serving as a reference upon setting of the fixing temperature exceeds a predetermined value, the thickness of the print medium serving as a reference upon setting of the fixing temperature is updated by the average value; and the target temperature of the fixing device in a next print job is set on the basis of the updated thickness of the print medium serving as a reference upon setting of the fixing temperature.

Further, in the method, the image forming apparatus further has a plurality of paper feed trays and means which detects the thickness of the first print medium after the print media were set onto each of the paper feed trays and stores the detected thickness; and the target temperature of the fixing device is set on the basis of the thickness of the print medium stored for every paper feed tray in subsequent printing.

Further, in the method, when a detection value of the thickness of the print medium is out of a predetermined range, the target temperature of the fixing device is set on the basis of a preset initial value of the print medium thickness.

Also, according to the present invention, there is provided an image forming apparatus for forming an image by an electrophotographic process, comprising:

a medium thickness detecting section for detecting a thickness of print medium, which detects a thickness of the print medium that is used after a predetermined operation, and detects a thickness of the print medium at a predetermined print period;

a fixing device; and a target temperature setting section which sets a target temperature of the fixing device on the basis of the thickness obtained after the predetermined operation and the thickness obtained at the predetermined print period.

In the apparatus the predetermined operation is a cleaning process executed at a time other than an image forming period of time, and the target temperature setting section sets the target temperature of the fixing device during which the cleaning process is executed.

Also, according to the present invention, there is provided an image forming apparatus for forming an image by an electrophotographic process, comprising:

a medium character detecting section for detecting a character of print medium, which detects a character of the print medium that is used after a predetermined operation, and detects a character of the print medium at a predetermined print period;

a fixing device; and a target temperature setting section which sets a target temperature of the fixing device on the basis of the character obtained after the predetermined operation and the character obtained at the predetermined print period.

According to the invention, the waiting time can be shortened and the print quality can be maintained.

The above and other objects and features of the present invention will become apparent from the following detailed description and the appended claims with reference to the accompanying drawings.

BRIEF DESCRIPTION OF THE DRAWINGS

FIG. 2 is a diagram showing a construction of a conventional image forming apparatus;

FIG. 3 is a diagram showing a construction of a conventional color image forming apparatus;

FIG. 8 is a time chart showing the operation of an image forming apparatus in the third embodiment of the invention;

FIG. 9 is a table showing the operation of an image forming apparatus in the fourth embodiment of the invention;

DETAILED DESCRIPTION OF THE PREFERRED EMBODIMENTS

Embodiments of the invention will be described in detail hereinbelow with reference to the drawings.

Figure 1:
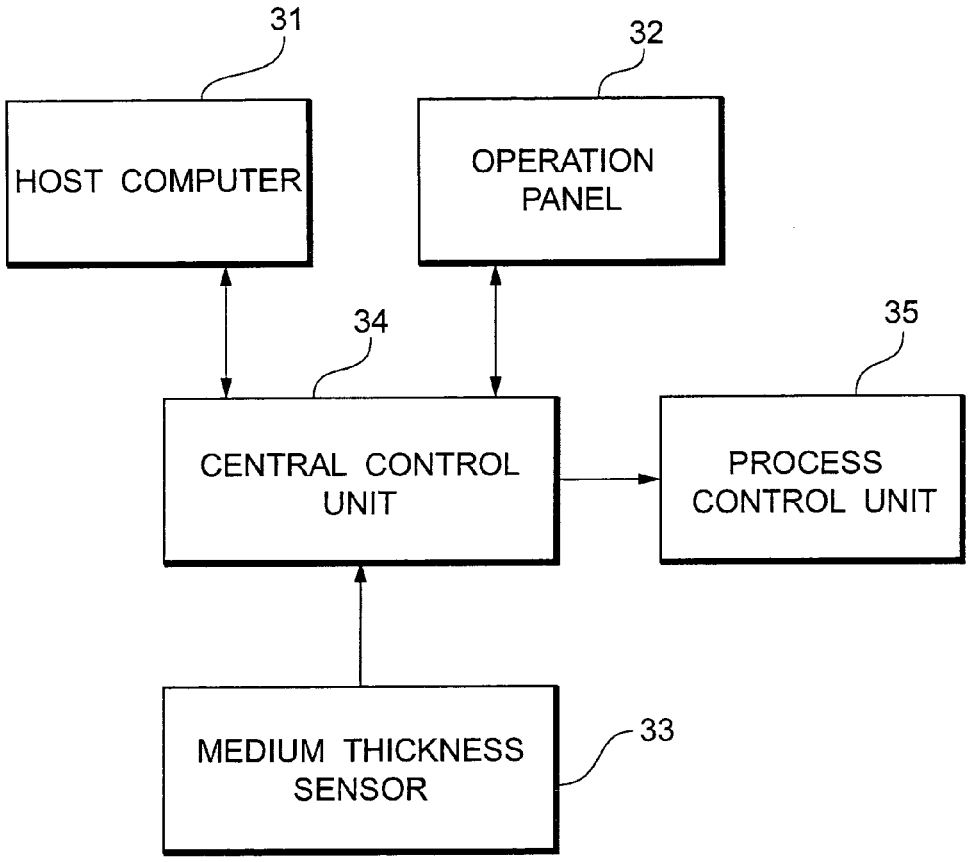
FIG. 1 is a block diagram showing a construction of a control unit of an image forming apparatus according to the first embodiment of the invention.

FIG. 1 is a block diagram showing a construction of a control unit of an image forming apparatus according to the first embodiment of the invention.

In the diagram, reference numeral 34 denotes a central control unit which controls the operation of the image forming apparatus and 35 indicates a process control unit which controls process values such as transfer voltage, developing voltage, fixing temperature, and the like in the image forming apparatus. With respect to the construction of the image forming apparatus in the embodiment, the description about the image forming apparatus shown in FIGS. 2 and 3 in "Related Background Art" is also used in common.

Reference numeral 31 denotes an upper host computer connected to the image forming apparatus through a communication line or a network (not shown) so that it can communicate therewith. The user who uses the image forming apparatus operates the host computer 31 and forms print data, or makes a printer setup of the image forming apparatus, and can transmit the print data and printer setup data to the central control unit 34. Reference numeral 32 denotes an operation panel arranged in a main body of the image forming apparatus. The user can make the printer setup or the like by operating the operation panel 32.

Reference numeral 33 denotes a medium thickness sensor as medium thickness detecting means which is arranged between the resist roller 25 and a position before a print medium enters the transfer belt 16 and detects a thickness of print medium.

When the central control unit 34 receives the data of the printer setup and the like received from the host computer 31 or the operation panel 32 and the thickness data of the print medium received from the medium thickness sensor 33, the central control unit 34 forms necessary control data and transmits it to the process control unit 35. On the basis of the control data received from the central control unit 34, the process control unit 35 controls the process values such as transfer voltage, developing voltage, fixing temperature, and the like in the image forming apparatus.

The central control unit 34 counts the number of print pages and is controlled so as to enter a cleaning sequence when a count value reaches the specific number of print pages. The cleaning sequence is a cleaning process for removing an unnecessary developing agent from members which are used to form an image at timing other than the image creation by an electrophotographic process. In this case, for preventing deterioration in print quality, an electrophotographic processing portion is cleaned, and separately from the cleaning for removing the non-transfer toner remaining on the photosensitive drum 11 upon creation of the image, each time the printing of a predetermined interval or a predetermined number of print pages is finished, anti-charged toner and the like deposited onto the photosensitive drum 11 and members such as a roller and the like which are in contact with the drum 11 are removed and such an operation is executed at timing other than the image creation.

There is also a case where it is necessary to change the interval or the number of print pages in accordance with an environment or a print image. In such a case, they can be also changed by the operation panel 32. The predetermined interval denotes a time interval during which the photosensitive drum is operating for printing or preparation for it.

The cleaning sequence will now be described.

In the image forming apparatus as shown in FIG. 2, a negative voltage is applied to the charging roller 12 from a power source apparatus (not shown). When the photosensitive drum 11 is come into contact with the charging roller 12, the surface of the drum 11 is uniformly charged to a predetermined surface potential. When the uniformly charged surface of the photosensitive drum 11 reaches under the exposing apparatus 13, it is selectively exposed by the exposing apparatus 13 in accordance with an image to be formed. Thus, the surface potential of the photosensitive drum 11 in the portion where an electrostatic latent image has been written is set to a value that is closer to the 0 [V] side than the non-exposed portion.

The surface of the photosensitive drum 11 after completion of the writing of the electrostatic latent image is come into contact with the developing roller 14 by the rotation of the photosensitive drum 11. The developing roller 14 has a predetermined pressure, is come into contact with the photosensitive drum 11, and rotated. The toner layer on the developing roller 14 is thinned by a toner restricting member (not shown). Development is performed by the contact with the photosensitive drum 11 by the rotation of the developing roller 14.

If the developing system is the inversion development in which the toner has charges of the same polarity as the uniform charging polarity of the photosensitive drum 11, the negative voltage is applied to the developing roller 14 from the power source (not shown) and the toner on the developing roller 14 is developed onto the photosensitive drum 11.

The surface of the photosensitive drum 11 after the development reaches a position of the transfer roller 17 by the rotation of the photosensitive drum 11. The transfer roller 17 is come into contact with the photosensitive drum 11 by the predetermined pressure and is rotated. A positive voltage is applied to the transfer roller 17 by the power source apparatus (not shown), so that the toner on the photosensitive drum 11 is developed onto the print medium conveyed by the transfer belt 16.

The print medium after completion of the transfer is separated from the photosensitive drum 11 and inserted into the fixing device 24 as shown in FIG. 3. After the fixing is finished, the print medium is ejected as printed matter to the outside from the image forming apparatus.

A part of the toner remains as non-transfer toner on the surface of the photosensitive drum 11 after the transfer. However, since the photosensitive drum 11 continues to rotate, the surface of the drum 11 is come into contact with the cleaning blade 18 together with the non-transfer toner and the non-transfer toner on the photosensitive drum 11 is removed by the cleaning blade 18. A negative voltage is applied to the cleaning blade 18 from the power source (not shown). After completion of the removal of the non-transfer toner, the photosensitive drum 11 is rotated and enters the charging process again.

In such a printing process, there is a case where a small amount of anticharged toner is adhered onto the photosensitive drum 11. It is considered that the anticharged toner is generated when the toner layer is formed onto the developing roller 14 or generated by an influence of the transfer voltage in the transfer process.

The anticharged toner on the photosensitive drum 11 is subjected to a Coulomb's force toward the charging roller 12 side in the charging process. Thus, the anticharged toner is adhered onto the charging roller 12. Therefore, it is necessary to execute a cleaning sequence for removing the anticharged toner adhered and deposited onto the charging roller 12 at a point of time when the printing of a specified number of print pages is finished.

An example of the cleaning sequence will now be described.

In this case, the power source which has applied the positive voltage to the transfer roller 17 upon printing is switched so as to apply 0 [V] at predetermined timing. The surface of the photosensitive drum 11 which is in contact with the transfer roller 17 is come into contact with the cleaning blade 18. At this timing, the power source which has applied the positive voltage so far is switched so as to apply the negative voltage to the cleaning blade 18. In this case, the negative voltage which is applied to the cleaning blade 18 is set to an electric potential that is close to the negative voltage which is applied to the charging roller 12. Therefore, the surface of the photosensitive drum 11 which is in contact with the cleaning blade 18 is uniformly charged to an electric potential that is close to that in the case where it is come into contact with the charging roller 12.

Thus, the non-transfer toner adhered and deposited onto the cleaning blade 18 is subjected to the Coulomb's force from the photosensitive drum 11 and moved and adhered onto the photosensitive drum 11 side. The surface of the photosensitive drum 11 onto which the non-transfer toner has been adhered reaches the position where it is come into contact with the charging roller 12 because of the rotation of the photosensitive drum 11. However, since the negative voltage has been applied to the charging roller 12, the non-transfer toner is subjected to the Coulomb's force onto the photosensitive drum 11 side and held in the state where it has been adhered onto the photosensitive drum 11 and is not moved to the charging roller 12 side.

Further, the surface of the photosensitive drum 11 onto which the non-transfer toner has been adhered is come into contact with the developing roller 14 because of the rotation of the photosensitive drum 11. Since the negative voltage on the 0 [V] side than the surface potential of the photosensitive drum 11 has been applied to the developing roller 14, the non-transfer toner on the surface of the photosensitive drum 11 is subjected to the Coulomb's force and moved to the developing roller 14 side. That is, the non-transfer toner is collected by the developing roller 14.

Subsequently, the negative voltage applied to the charging roller 12 is switched to 0 [V]. In this case, on an upstream of the charging roller 12, since the negative voltage has been applied to the cleaning blade 18, the surface of the photosensitive drum 11 is charged to the negative electric potential. Therefore, the anticharged toner adhered and deposited onto the charging roller 12 is subjected to the Coulomb's force onto the photosensitive drum 11 side and moved and adhered onto the photosensitive drum 11 side. The surface of the photosensitive drum 11 onto which the anticharged toner has been adhered and deposited is come into contact with the developing roller 14 because of the rotation of the photosensitive drum 11.

Just before the surface of the photosensitive drum 11 onto which the anticharged toner has been adhered and deposited is come into contact with the developing roller 14, the negative voltage supplied to the developing roller 14 is switched to 0 [V]. Therefore, the anticharged toner on the photosensitive drum 11 is subjected to the Coulomb's force of the photosensitive drum 11 and is not moved to the developing roller 14 side but passes.

The partial non-transfer toner remaining on the photosensitive drum 11 is subjected to the Coulomb's force from the developing roller 14 and moves to the developing roller 14 side. The surface of the photosensitive drum 11 is come into contact with the transfer roller 17 because of the rotation of the photosensitive drum 11.

Just before the surface of the photosensitive drum 11 is come into contact with the transfer roller 17, the power source which has applied 0 [V] to the transfer roller 17 supplies the positive voltage. Therefore, the anticharged toner on the photosensitive drum 11 is subjected to the Coulomb's force of the photosensitive drum 11 and is not moved to the transfer roller 17 side but passes. Further, the portion on the photosensitive drum 11 to which the anticharged toner has been adhered is come into contact with the cleaning blade 18 because of the rotation of the photosensitive drum 11.

Since the negative voltage has been applied to the cleaning blade 18, the anticharged toner on the photosensitive drum 11 is subjected to the Coulomb's force from the cleaning blade 18. Therefore, the anticharged toner is moved to the cleaning blade 18 side and adhered and deposited onto the surface of the cleaning blade 18.

In such a cleaning sequence, the voltage which is applied to the charging roller 12 is changed in accordance with the number of print pages. It can be also changed in accordance with a print speed in the image forming apparatus and materials of the toner and the charging roller 12. Thus, the adhesion and deposition of the anticharged toner on the charging roller 12 can be suppressed.

Since the printing process is interrupted when the apparatus enters the cleaning sequence, in the embodiment, the medium thickness sensor 33 measures the thickness of print medium at the time of the cleaning sequence and transmits a measurement result to the central control unit 34. After the measurement of the thickness of print medium and the cleaning sequence are finished, the printing process is restarted.

Although the example in which the voltage is applied to the cleaning blade 18 has been mentioned in the above explanation, it is also possible that the unnecessary toner is simply scraped off without applying the voltage.

A construction of the medium thickness sensor 33 will now be described.

Figure 4:
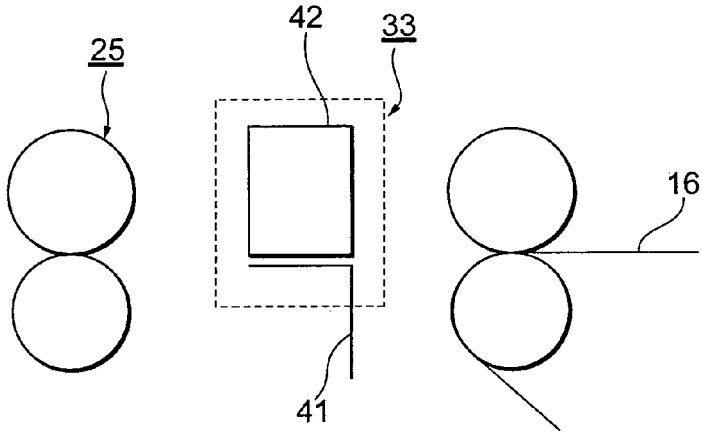
FIG. 4 is a diagram showing an arranging position of a medium thickness sensor in the first embodiment of the invention.
Figure 5:
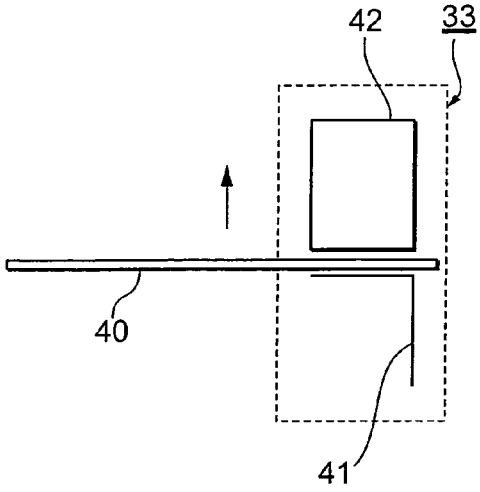
FIG. 5 is a diagram showing the operation of the medium thickness sensor in the case where there is a medium in the first embodiment of the invention.
Figure 6:
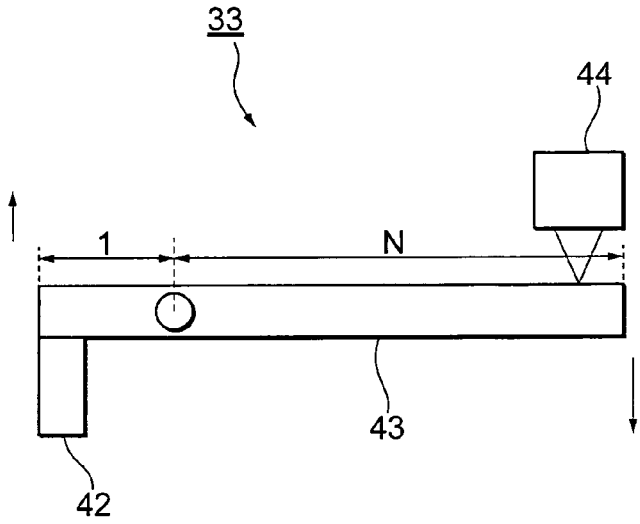
FIG. 6 is a diagram showing the operation of a mechanical amplifier of the medium thickness sensor in the first embodiment of the invention.

FIG. 4 is a diagram showing an arranging position of the medium thickness sensor in the first embodiment of the invention. FIG. 5 is a diagram showing the operation of the medium thickness sensor in the case where there is a medium in the first embodiment of the invention. FIG. 6 is a diagram showing the operation of a mechanical amplifier of the medium thickness sensor in the first embodiment of the invention.

In FIG. 4, reference numeral 41 denotes a plate stage fixed to a chassis (not shown) of the image forming apparatus and 42 indicates a pickup portion which is vertically moved. As shown in FIG. 5, the pickup portion 42 is pushed upward by a print medium 40 such as paper or the like. As shown in FIG. 6, the pickup portion 42 is fixed to one end of a rod member 43 attached so as to be rotatable around a fulcrum in an eccentric state. Therefore, a displacement amount of the pickup portion 42 is amplified by the principles of the lever and fulcrum and appears as a displacement amount of the other end of the rod member 43. The displacement amount of the other end is measured by a micro displacement sensor 44.

It is now assumed that a distance from the fulcrum to the pickup portion 42 fixed to one end of the rod member 43 is equal to "1" and a distance from the fulcrum to the detecting position of the micro displacement sensor 44 at the other end of the rod member 43 is equal to "N". In this case, since the displacement amount of the pickup portion 42 is amplified to N times and measured by the micro displacement sensor 44, measuring precision can be improved. Actually, it is desirable to set "N" to a value of 4 to 5 (N=4~5) in consideration of the displacement amount due to the print medium 40, a measurable area of the micro displacement sensor 44, and the like.

The operation of the image forming apparatus with the above construction will now be described.

First, when the printing of the first one of the print media after a paper feed tray was set is activated, the medium thickness sensor 33 measures the thickness of print medium 40. A fixing temperature according to the measured thickness is set as a target value. That is, a target temperature of the fixing device 24 is set in accordance with the thickness of print medium 40. When the fixing temperature in the fixing device 24 reaches a print-ready temperature, the print medium 40 is fed to the transfer portion of the drum unit.

The thickness of each of the second and subsequent print media 40 stacked on the paper feed tray is not measured but the printing is continued at the same fixing temperature as that set on the basis of the thickness of the first print medium 40.

When the printing of the specified number of print media 40 is finished, the cleaning sequence is executed. Since the printing process is once interrupted in the cleaning sequence, the thickness of print medium 40 is measured at the interruption timing. The thickness of print medium 40 for setting the fixing temperature is updated by an average value of the measured thickness of print medium 40 and the thickness of print medium 40 which has previously been measured. The thickness of print medium 40 which has previously been measured denotes the thickness of the first print medium 40 on the paper feed tray or the thickness of print medium 40 updated in the previous cleaning sequence.

Subsequently, when the thickness of print medium 40 for setting the fixing temperature is updated, the target value of the fixing temperature is switched to the target value of the fixing temperature according to the updated thickness of print medium 40. When the switching of the target value of the fixing temperature is completed and the cleaning sequence is completed, the printing process is restarted.

The transfer voltage, developing voltage, exposure value, and the like as process values other than the fixing temperature can be also switched in accordance with the updated thickness of print medium 40.

As mentioned above, the fixing temperature control method in the embodiment has: the step wherein the thickness of print medium 40 is measured for the cleaning processing period of time; and the step wherein the target temperature of the fixing device 24 is set in accordance with the thickness of print medium 40. The target temperature of the fixing device 24 is set in accordance with the average value of the measured thickness of print medium 40 and the thickness of print medium 40 which has previously been measured. In this case, the thickness of print medium 40 is also measured in the cleaning sequence. Therefore, the problem which occurs in the case of measuring the thickness of only the first print medium 40 on the paper feed tray as in the conventional method can be avoided. In other words, if the thickness of only the first print medium 40 on the paper feed tray is measured, there is a possibility that the target value of the fixing temperature is set on the basis of the improper thickness due to measurement errors of the medium thickness sensor 33 or a variation in thickness of each print medium 40 and the print quality deteriorates.

On the other hand, in the embodiment, since the thickness of print medium 40 is measured also in the cleaning sequence and the thickness of print medium 40 for setting the fixing temperature is updated by the average value of the measured thickness of print medium 40 and the thickness of print medium 40 which has previously been measured, the variations of the measured values of the thicknesses of the print media 40 are averaged and more accurate control can be made. Therefore, such a problem that the defective printing or the defective fixing occurs and the print medium 40 is wrapped around the fixing device 24 and the image forming apparatus is broken at worst can be avoided. Moreover, such a problem that the throughput of the image forming apparatus is remarkably deteriorated as in the case of measuring the thickness each time the print medium 40 is fed can be prevented.

In the embodiment, after the paper feed tray was set, the thickness of the first print medium has been detected and the fixing temperature according to the detected thickness has been set as a target value. However, when a plurality of paper feed trays exist, the thickness of the first print medium in each tray can be also detected by the switching operation of the paper feed trays which are used.

The second embodiment of the invention will now be described. Component elements having substantially the same structures as those in the first embodiment are designated by the same reference numerals and their description is omitted here.

Figure 7:
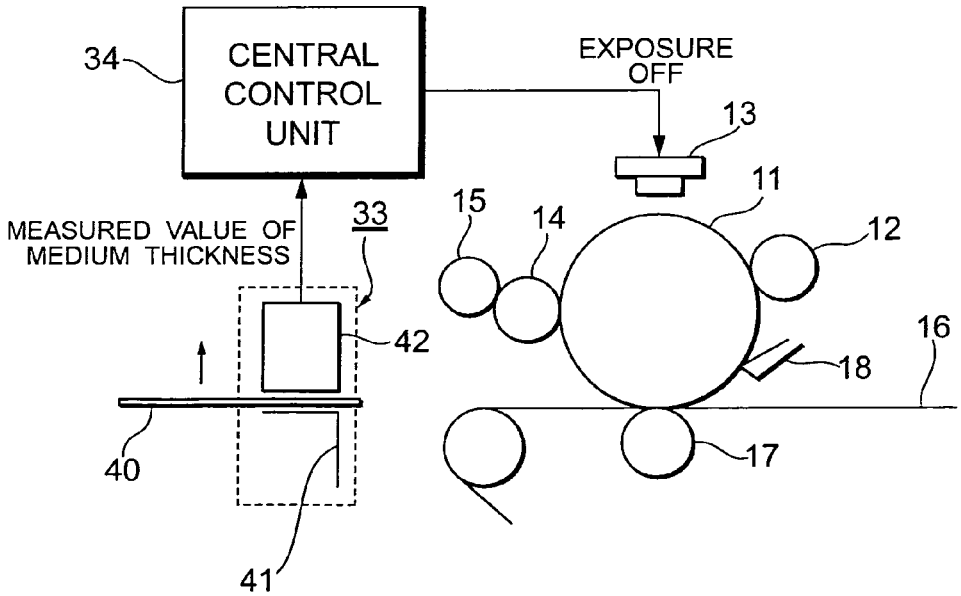
FIG. 7 is a diagram showing a construction of an image forming apparatus according to the second embodiment of the invention.

FIG. 7 is a diagram showing a construction of an image forming apparatus according to the second embodiment of the invention. In FIG. 7, only the drum unit of black locating on the top stream of the transfer belt 16 is illustrated.

In the first embodiment mentioned above, the thickness of the first print medium 40 on the paper feed tray has been measured and the thickness of print medium 40 is also measured in the cleaning sequence. However, the thickness of print medium 40 which is printed for a time interval until the cleaning sequence is executed after the first print medium 40 on the paper feed tray was printed is not measured. Therefore, if the print medium 40 whose thickness largely differs from the thickness of the first print medium 40 is mixed among the second and subsequent print media on the paper feed tray, there is a possibility of occurrence of the defective printing. However, if the thicknesses of all of the print media 40 are measured and the target value of the fixing temperature is switched each time on the basis of the measured thicknesses, the throughput of the image forming apparatus deteriorates remarkably.

To solve such a problem, therefore, in the second embodiment, although the thicknesses of the second and subsequent print media 40 on the paper feed tray are also measured, the target value of the fixing temperature is not changed on the basis of the measured thicknesses but the target value of the fixing temperature determined on the basis of the thickness of the first print medium 40 on the paper feed tray is maintained and, with respect to the second and subsequent print media 40, extents of errors between their thicknesses and the thickness of the first print medium 40 are monitored.

In this example, now assuming that the thickness of each of the second and subsequent print media 40 is deviated from the thickness of the first print medium 40 by a predetermined value (±50 [μm] in the embodiment) or more, the print media 40 are the different kinds of print media or have been overlay-fed (a plurality of print media 40 are fed in an overlaid state), so that it is determined that the error occurred. Even if the occurrence of the error is decided, the print media 40 are ejected as blank sheets of paper without stopping the paper feed of the print media 40. Thus, the troublesome operation such as cancellation of paper jam can be also lightened.

In the embodiment, as shown in FIG. 7, the central control unit 34 receives the thicknesses of print media 40 measured by the medium thickness sensor 33. If the thicknesses of the second and subsequent print media 40 are deviated from the thickness of the first print medium 40 by the predetermined value or more, the central control unit 34 determines the occurrence of the error and forcedly turns off the operation of the exposing apparatus 13 of all colors. Consequently, even if the print data exists, the exposure is not executed but blank-paper printing is executed.

By this method, the accident which is caused by the wrapping onto the fixing device 24 that becomes a problem when the print density is high can be prevented and the print media 40 are ejected without stopping, so that the annoying operation to cancel the paper jam can be omitted.

As a method of forcedly turning off the exposure, there is a method whereby an ENABLE signal for light emission is not made operative, a method whereby a logic process (AND process) of the print data is executed and everything is cleared, or the like.

The operation of the image forming apparatus with the above construction will now be described.

First, when the printing of the first one of the print media on the paper feed tray is activated, the medium thickness sensor 33 measures the thickness of print medium 40. A fixing temperature according to the measured thickness is set as a target value. When the fixing temperature in the fixing device 24 reaches the print-ready temperature, the print medium 40 is fed to the transfer portion of the drum unit.

Subsequently, the central control unit 34 receives the thicknesses of print media 40 measured by the medium thickness sensor 33. If the thicknesses of the second and subsequent print media 40 are deviated from the thickness of the first print medium 40 by the predetermined value or more, the central control unit 34 determines the occurrence of the error and forcedly turns off the operation of the exposing apparatus 13 of all colors. In this case, since the surface of the photosensitive drum 11 is not exposed by the exposing apparatus 13, the drum surface reaches the position where it is come into contact with the developing roller 14 by the rotation of the photosensitive drum 11 while holding a large quantity of minus charges. Since an electric field acts in the direction of the photosensitive drum 11 from the developing roller 14, the toner charged to the minus polarity does not move to the photosensitive drum 11 side.

Therefore, since the toner image which is transferred onto the print medium 40 is not formed, even if the print medium 40 is thin paper, the wrapping onto the fixing device 24 which is caused when the image of a high density in each color is transferred can be prevented. The print medium 40 which has passed through the transfer portion of each color in the state of the blank paper also passes through the fixing device 24 as it is and is ejected.

As mentioned above, in the embodiment, when the difference between the measured thickness of print medium 40 and the thickness of print medium 40 as a reference is equal to or larger than the predetermined value, the image creation is not formed but the print medium 40 is ejected. In this case, the thicknesses of the second and subsequent print media 40 on the paper feed tray are also measured. If the thicknesses of the second and subsequent print media 40 are deviated from the thickness of the first print medium 40 by the predetermined value or more, the central control unit 34 determines the occurrence of the error and forcedly turns off the operation of the exposing apparatus 13 of all colors. Consequently, even if the print media 40 are the different kinds of print media or have been overlay-fed, the blank-paper printing is executed. Therefore, the accident in which the print medium 40 is wrapped around the fixing device 24 can be reduced.

Since the medium is ejected in the state of the blank-paper printing, the print medium 40 does not remain in the image forming apparatus and the apparatus can be always set into the data standby mode. Therefore, operating efficiency of the image forming apparatus can be improved without accumulating the print data from other users. By performing the blank-paper printing, an amount of toner which is wastefully consumed can be also reduced.

Further, since measured thicknesses of print media 40 are not reflected to the setting of the target value of the fixing temperature, the temperature waiting state due to the switching of the target value of the fixing temperature does not occur. The throughput of the image forming apparatus does not deteriorate, either.

The third embodiment of the invention will now be described. Component elements having substantially the same structures as those in the first and second embodiments are designated by the same reference numerals and their description is omitted here.

FIG. 8 is a time chart showing the operation of an image forming apparatus in the third embodiment of the invention.

In the first embodiment mentioned above, the thickness of the first print medium 40 on the paper feed tray has been measured and the thickness of print medium 40 is also measured in the cleaning sequence. The thickness of print medium 40 for setting the fixing temperature is updated by the average value of the measured thickness of print medium 40 and the thickness of print medium 40 which has previously been measured. However, the time necessary for the cleaning sequence is often shorter than the time necessary for increasing or decreasing the fixing temperature so as to follow the change in target value of the fixing temperature. That is, it is considered that even after completion of the cleaning sequence, the temperature of the fixing device 24 does not reach the changed target value.

In the embodiment, therefore, priority is given to the throughput of the image forming apparatus. During the continuous printing, the thickness of print medium 40 for setting the fixing temperature is updated on the basis of the thickness of print medium 40 measured in the cleaning sequence. However, the target value of the fixing temperature is not changed until the continuous printing is finished. That is, when a print job of the continuous printing is finished and the next print job is generated, the target value of the fixing temperature is changed on the basis of the updated thickness of print medium 40 and the printing process is started. The updated thickness of print medium 40 is used as a reference for monitoring the extent of errors described in the second embodiment mentioned above.

The operation of the image forming apparatus with the above construction will now be described.

First, when the printing of the first one of the print media on the paper feed tray is activated, the medium thickness sensor 33 measures the thickness of print medium 40. A fixing temperature according to the measured thickness is set as a target value. When the fixing temperature in the fixing device 24 reaches the print-ready temperature, the print medium 40 is fed to the transfer portion of the drum unit.

In FIG. 8, a pulse shown by t1 denotes timing for measuring the thickness of the first print medium 40 in order to set the target value of the fixing temperature. Pulse shown by t2 denote timing for measuring the thickness of print medium 40 in order to monitor the extent of errors in comparison with the thickness of the first print medium 40 with respect to the second and subsequent print media 40. t3 denotes a period of time during which the cleaning sequence is executed. A pulse shown by t4 denotes timing for measuring the thickness of print medium 40 in the cleaning sequence in order to update the thickness of print medium 40 for setting the fixing temperature.

In this case, the thicknesses of the second and subsequent print media 40 are also measured and the extent of errors in comparison with the thickness of the first print medium 40 with respect to the second and subsequent print media 40 is monitored. The thicknesses of the second and subsequent print media 40 are also monitored and the extent of errors in comparison with the thickness of the first print medium 40 is monitored. The thicknesses of the second and subsequent print media 40 are not reflected to the setting of the fixing temperature.

When the continuous printing continues and the operating mode enters the cleaning sequence, the thickness of print medium 40 is measured and the thickness of print medium 40 for setting the fixing temperature is updated by the average value of the measured thickness of print medium 40 and the thickness of print medium 40 which has previously been measured. The thickness of print medium 40 for setting the fixing temperature can be updated by the most frequent value of the measured thicknesses of print media 40. Further, the thickness of print medium 40 for setting the fixing temperature can be updated every time by the most frequent value of the thicknesses of print media 40 which has been measured. However, the target value of the fixing temperature is not updated but is used as a reference for monitoring the extent of errors in comparison with the thickness of print medium 40, and the printing is continued.

As mentioned above, in the embodiment, the target temperature of the fixing device 24 is not changed until the continuous printing is finished. In this case, since the waiting time which is caused by the change in target value of the fixing temperature in the cleaning sequence is eliminated, the throughput of the image forming apparatus can be improved.

The thicknesses of print media 40 other than the first print medium 40 and the print media 40 whose thicknesses have been measured in the cleaning sequence are used for discriminating whether or not the print media 40 are different kinds of print media in combination with the foregoing second embodiment, so that the accident such as wrapping of the print medium 40 onto the fixing device 24 or the like can be prevented.

The fourth embodiment of the invention will now be described. Component elements having substantially the same structures as those in the first to third embodiments are designated by the same reference numerals and their description is omitted here.

FIG. 9 is a table showing the operation of an image forming apparatus in the fourth embodiment of the invention.

When the print medium 40 is thick paper (150 [μm] or more), a heat capacity necessary for fixing is larger than that in the case where the print medium 40 is plain paper serving as a normal paper with a normal thickness. Therefore, when the thick paper is designated as a print medium 40, a method whereby a print speed is reduced and fixing heat is supplied to the print medium 40 is used. Therefore, the thickness of the first print medium 40 is measured and if it is determined that the thickness is equal to or larger than 150 [μm], a thick paper mode is set as a print mode and the printing is executed at a speed lower than that of a plain paper mode.

However, in the case of the print medium 40 whose thickness is equal to a value between the thick paper and the plain paper (around 145 to 150 [μm]), there is a case where the thickness is determined to be less than 150 [μm] due to a reading error of the medium thickness sensor 33 and a variation in print media themselves. In this case, although the printing has to be inherently performed as a thick paper mode, the printing is executed as a plain paper mode.

Since the reliability is low in the case where the print mode is switched by simply measuring the thickness of the first print medium 40, therefore, in the third embodiment, the thickness of the second print medium 40 is measured and if it is determined that both of the first and second print media are the thick paper, the thick paper mode is set as a print mode. In this case, for example, if it is determined that the first print medium is the thick paper and the second print medium is the plain paper, the thickness of the third print medium 40 is measured and whether the third print medium is the thick paper or the plain paper is discriminated again. If it is determined that the third print medium is the thick paper, the thick paper mode is set as a print mode. The thicknesses measured with respect to the fourth and subsequent print media 40 are used for monitoring the extent of errors in comparison with the thickness of print medium 40 serving as a reference as shown in the second embodiment. That is, the thickness of the first print medium 40 is measured and if it is determined that it is the thick paper, the thicknesses of print media 40 are measured three times at the maximum and whether each print medium is the thick paper or not is discriminated. The mode determined twice in the determinations is set. Although the mode is determined on the basis of the judgments of twice among the judgments of thrice in this case, that is, by a majority decision logic, it is also possible to calculate an average value of the thicknesses and decide the print mode from the average value.

The operation of the image forming apparatus with the above construction will now be described.

First, when the printing of the first one of the print media on the paper feed tray is activated, the medium thickness sensor 33 measures the thickness of print medium 40. If it is determined that the first print medium is the thick paper, the thick paper mode is set as a print mode. The first print medium is printed in the thick paper mode and ejected from the image forming apparatus.

Subsequently, the thickness of the second print medium 40 is also measured in a manner similar to the first print medium 40. If the second print medium 40 is also determined to be the thick paper in a manner similar to the first print medium 40, the setting of the thick paper mode is determined. The thicknesses measured with respect to the third and subsequent print media 40 are used for monitoring the extent of errors in comparison with the thickness of print medium 40 serving as a reference. Whether or not the third and subsequent print media 40 are different kinds of print media is discriminated.

If it is determined that the second print medium 40 is not the thick paper but the plain paper, the second print medium 40 is printed in the plain paper mode and ejected from the image forming apparatus. Subsequently, the thickness of the third print medium 40 is also measured in a manner similar to the first print medium 40. If the third print medium 40 is determined to be the thick paper, the setting of the thick paper mode is determined. If it is determined that the third print medium 40 is the plain paper, the setting of the plain paper mode is determined and the fourth and subsequent print media are printed in the plain paper mode.

It is also possible to construct the apparatus in such a manner that if it is determined a predetermined number of times or more continuously that the print medium 40 is the thick paper, the setting of the thick paper mode is determined or if the number of times of decision showing that the print medium 40 is the thick paper is the majority number, the setting of the thick paper mode is determined.

As mentioned above, in the embodiment, the print mode is decided on the basis of the measured thicknesses of a plurality of print media 40. In this case, the thickness of the first print medium 40 is measured and if it is determined that the first print medium 40 is the thick paper, the thickness of the second print medium 40 is measured and, if necessary, the thickness of the third print medium 40 is also measured in a manner similar to the first print medium, thereby deciding the print mode. Therefore, the reliability of the operation can be raised. That is, there is a case where the print medium 40 having a thickness near the boundary of switching of the print mode is determined to be the thick paper or the plain paper due to the reading error of the medium thickness sensor 33 and the variation in print medium itself. In the four embodiment, however, since the thicknesses of print media 40 are measured a plurality of number of times and whether the print medium is the thick paper or not is discriminated, the influence by the reading error of the medium thickness sensor 33 and the variation in print medium itself can be eliminated.

The fifth embodiment of the invention will now be described. Component elements having substantially the same structures as those in the first to fourth embodiments are designated by the same reference numerals and their description is omitted here.

Figure 10A:
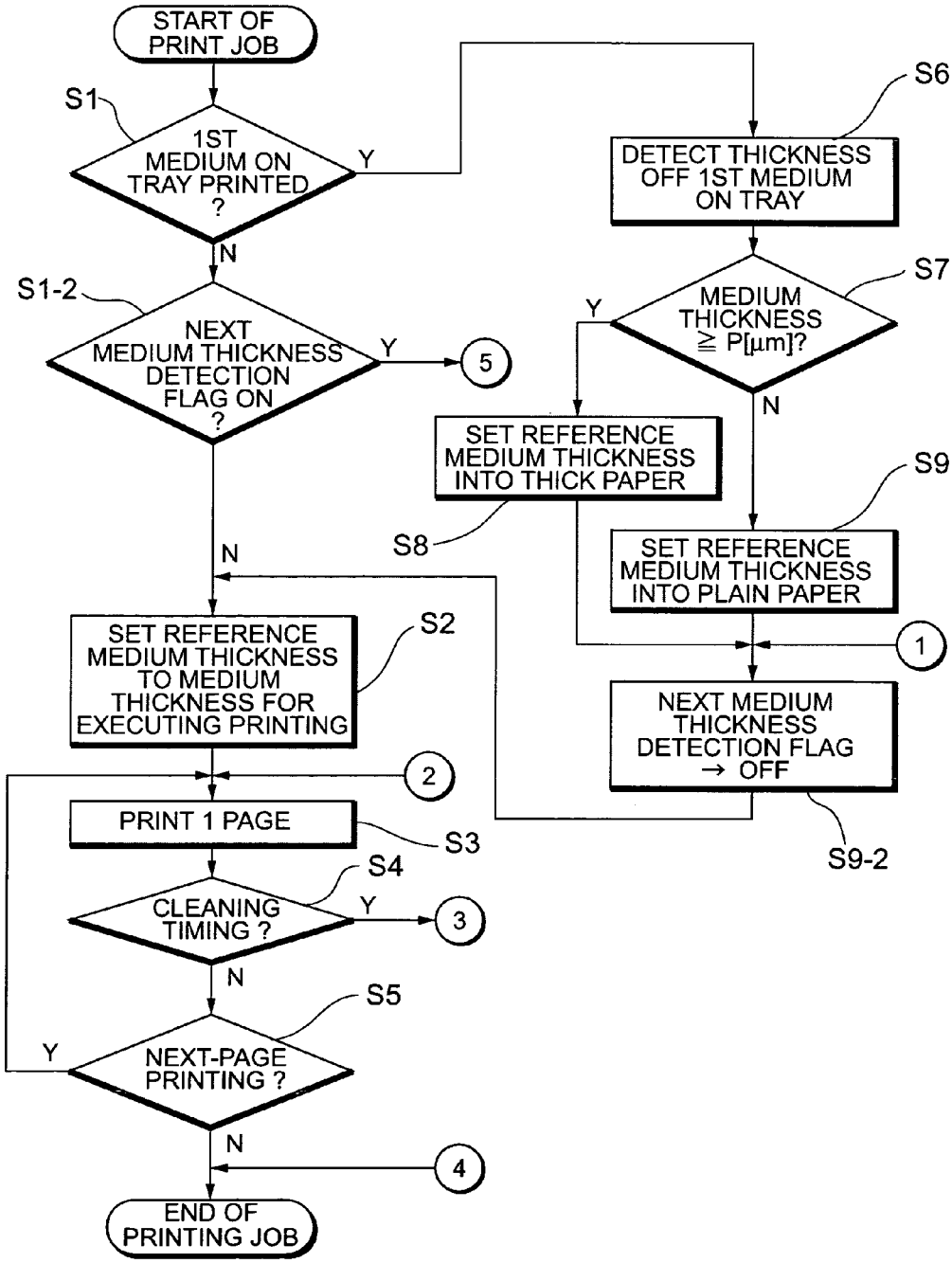
FIG. 10 is a flowchart showing the operation of an image forming apparatus in the fifth embodiment of the invention.
Figure 10B:
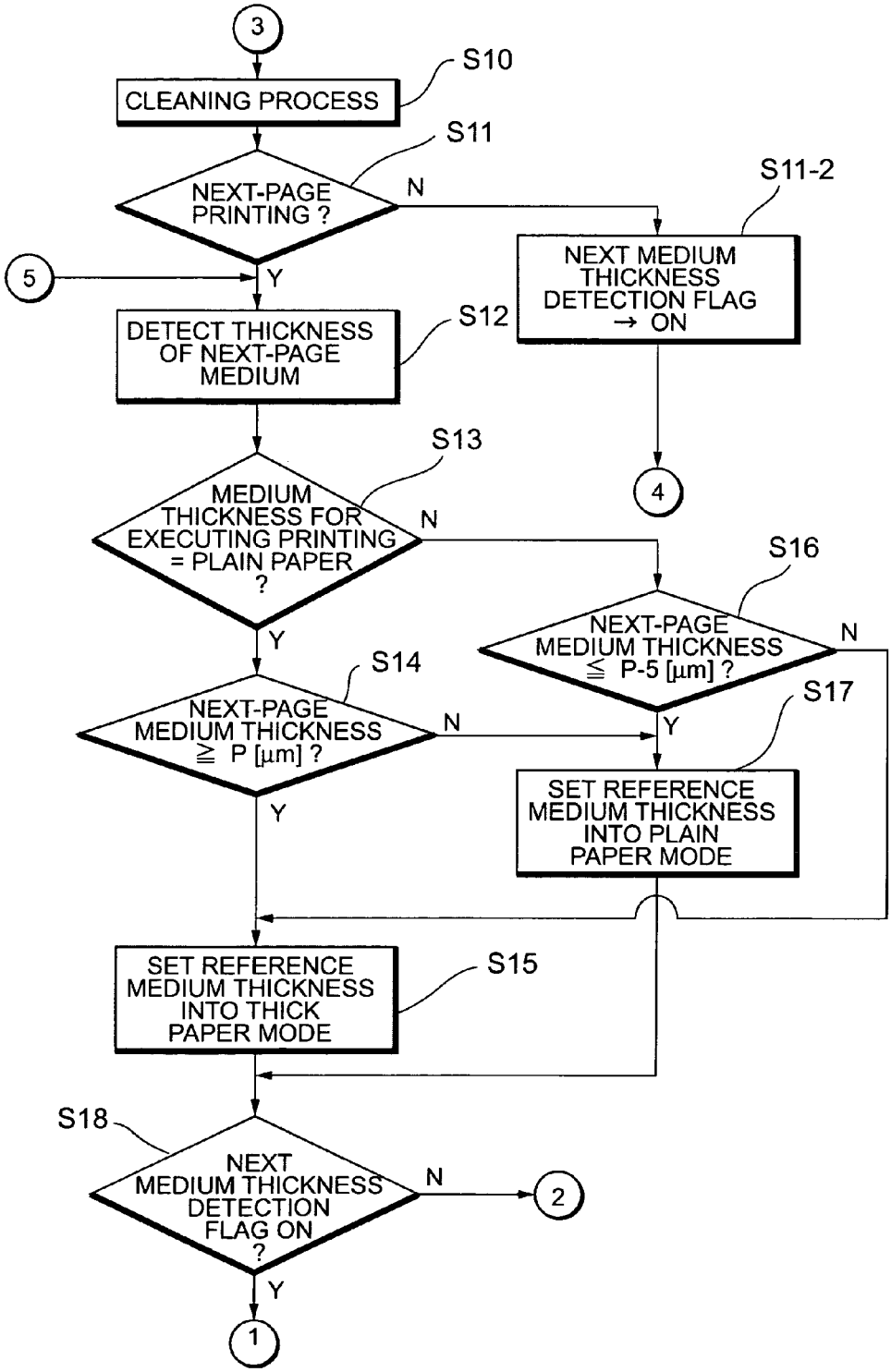

FIG. 10 is a flowchart showing the operation of an image forming apparatus in the fifth embodiment of the invention.

Although the average value of the thicknesses of print media 40 is updated every cleaning sequence in the first embodiment, in the fifth embodiment, a control method whereby when the media are switched, that is, when the kind of print medium 40 is changed, the thickness of print medium 40 exceeds a threshold value will now be described.

For example, when the measured thickness of the first one of the print media stacked on the paper feed tray is equal to a value between the thick paper and the plain paper, there is a fear that this medium is the plain paper due to the reading error of the medium thickness sensor 33 and the variation in print medium itself. After the printing is continuously executed, when the thickness of print medium 40 is measured in the cleaning sequence, if the print medium is contrarily determined to be the thick paper, the print medium is printed in the thick paper mode when the next print job is generated as described in the fourth embodiment.

In the case of the thick paper, since a heat capacity necessary for fixing is larger than that in the case of the plain paper, it is necessary to raise the fixing temperature. However, since a heat resisting temperature of the apparatus such as a fixing device 24 or the like has been predetermined, the fixing temperature cannot be raised thoughtlessly. Therefore, a method whereby the print speed is reduced and fixing heat necessary for the thick paper is supplied is ordinarily used. In this case, the thick paper mode is set as a print mode and the printing is executed at a speed lower than that in the plain paper mode. After the printing is executed in the thick paper mode, when the thickness of print medium 40 is measured in the cleaning sequence, if this medium is decided to be the thick paper, the print mode is returned to the plain paper mode and the printing is executed when the next print job is generated. As mentioned above, when the thickness of print medium 40 is close to the threshold value of the plain paper and the thick paper, the print mode is switched every start of the print job irrespective of the paper feed from the same paper feed tray. Therefore, the setting of the fixing temperature and the print speed are frequently switched and the waiting time becomes long.

In the fifth embodiment, therefore, the operation of the image forming apparatus is controlled so that the print mode is not frequently switched in dependence on the thickness of print medium 40 measured every cleaning sequence.

The operation of the image forming apparatus in the fifth embodiment will now be described. Since a construction of the image forming apparatus is similar to those in the first to fourth embodiments, its description is omitted here.

A threshold value P of the thickness of print medium 40 which is measured every cleaning sequence is defined between the plain paper and the thick paper as follows. That is, a condition to shift the print mode from the plain paper mode to the thick paper mode is defined as timing when the thickness of print medium 40 updated in the cleaning sequence is equal to or larger than the threshold value P [μm]. It is also assumed that the print mode is shifted from the thick paper mode to the plain paper mode only when the updated thickness decreases to (P−5) [μm].

First, when the print job is started, whether or not the first one of the print media stacked on the paper feed tray is printed, that is, whether or not the printing is the printing of the first medium on the tray is discriminated. If it is not the printing of the first medium, the standard medium thickness as a thickness of print medium 40 serving as a reference is set to the medium thickness for executing the printing as a thickness of print medium 40 for executing the printing. The printing of one sheet of print medium 40, that is, the printing of one page is executed. Subsequently, whether or not the operation timing is timing-for executing the cleaning sequence, that is, the cleaning timing is discriminated. If it is not the cleaning timing, whether or not the printing of the next print medium 40 is executed, that is, the next-page printing exists is discriminated. If the next-page printing does not exist, the print job is finished. If the next-page printing exists, the printing of one page is executed again.

Whether or not the printing is the printing of the first medium on the tray is discriminated. If it is the printing of the first medium, the medium thickness sensor 33 measures the thickness of print medium 40. That is, the thickness of the first medium on the tray is detected. Whether or not the thickness of print medium 40, that is, the medium thickness is equal to or larger than P [μm] is discriminated. If it is equal to or larger than P [μm], the standard medium thickness is set to the thick paper. If it is less than P [μm], the standard medium thickness is set to the plain paper. Subsequently, the set standard medium thickness is set to the medium thickness for executing the printing.

whether the operation timing is the cleaning timing or not is discriminated. If it is the cleaning timing, the cleaning sequence, that is, the cleaning process is executed. Subsequently, whether the next-page printing exists or not is discriminated. If the next-page printing does not exist, the print job is finished. If the next-page printing exists, the medium thickness of the next print medium 40 is detected, that is, the next-page medium thickness detection is performed. Whether or not the medium thickness for executing the printing indicates the plain paper is discriminated. If it indicates the plain paper, whether or not the thickness of the next print medium 40, that is, the next-page medium thickness is equal to or larger than P [μm] is discriminated. If it is equal to or larger than P [μm], the standard medium thickness is set to the thick paper mode. If it is less than P [μm], the standard medium thickness is set to the plain paper mode. Subsequently, the one-page printing is executed. Whether or not the medium thickness for executing the printing indicates the plain paper is discriminated. If it does not indicate the plain paper, whether or not the next-page medium thickness is equal to or less than (P−5) [μm] is discriminated. If it is equal to or less than (P−5) [μm], the standard medium thickness is set to the plain paper mode. If it is larger than (P−5) [μm], the standard medium thickness is set to the thick paper mode. Subsequently, the one-page printing is executed.

For example, assuming that the threshold value "P" is set to 150 [μm], when the thickness of the first medium on the tray is equal to 149 [μm], the apparatus operates as a plain paper mode. The set values are switched to the fixing temperature and the print speed suitable for the medium thickness. When the apparatus enters the print-ready mode, the printing is started. Now, assuming that when the printing is continued and the medium thickness is updated in the cleaning sequence, if it becomes equal to 151 [μm], the next print job operates as a thick paper mode. Further, it is assumed that during the operation in the thick paper mode, the medium thickness is updated in the cleaning sequence and returned to 149 [μm]. In this case, since the print mode is switched from the thick paper mode to the plain paper mode at the medium thickness of 145 [μm] (=150−5), the next print job also operates as a thick paper mode.

The flowchart will now be described.

Step S1: Whether or not the printing is the printing of the first medium on the tray is discriminated. If it is the printing of the first medium, step S6 follows. If it is not the printing of the first medium, step S1-2 follows.

Step S1-2: Whether or not a next medium thickness detection flag is on. If it is, step S12 follows. If it is not, step S2 follows.

Step S2: The standard medium thickness is set to the medium thickness for executing the printing.

Step S3: The one-page printing is executed.

Step S4: Whether the operation timing is the cleaning timing or not is discriminated. If it is the cleaning timing, step S10 follows. If it is not the cleaning timing, step S5 follows.

Step S5: Whether the next-page printing exists or not is discriminated. If the next-page printing exists, the processing routine is returned to step S3. If the next-page printing does not exist, the processing routine is finished.

Step S6: The medium thickness of the first medium on the tray is detected.

Step S7: Whether or not the medium thickness is equal to or larger than P [μm] is discriminated. If the medium thickness is equal to or larger than P [μm], step S8 follows. If the medium thickness is less than P [μm], step S9 follows.

Step S8: The standard medium thickness is set to the thick paper.

Step S9: The standard medium thickness is set to the plain paper.

Step S9-2: The next medium thickness detection flag is set to off, then step S2 follows.

Step S10: The cleaning process is executed.

Step S11: Whether the next-page printing exists or not is discriminated. If the next-page printing exists, step S12 follows. If the next-page printing does not exist, step S11-2 follows.

Step S11-2: The next medium thickness detection flag is set to on, then, the processing routine is finished.

Step S12: The thickness of the next-page medium is detected.

Step S13: Whether or not the medium thickness for executing the printing indicates the plain paper is discriminated. If the medium thickness for executing the printing indicates the plain paper, step S14 follows. If the medium thickness for executing the printing does not indicate the plain paper, step S16 follows.

Step S14: Whether or not the thickness of the next-page medium is equal to or larger than P [μm] is discriminated. If the thickness of the next-page medium is equal to or larger than P [μm], step S15 follows. If the thickness of the next-page medium is less than P [μm], step S17 follows.

Step S15: The standard medium thickness is set to the thick paper mode.

Step S16: Whether or not the thickness of the next-page medium is equal to or less than (P−5) [μm] is discriminated. If the thickness of the next-page medium is equal to or less than (P−5) [μm], step S17 follows. If the thickness of the next-page medium is larger than (P−5) [μm], step S15 follows.

Step S17: The standard medium thickness is set to the plain paper mode.

Step S18: whether or not the next medium thickness detection flag is on, if it is, step S9-2 follows, if it is not, step S3 follows.

As mentioned above, in the fifth embodiment, a margin is provided for the threshold value of the thickness of print medium 40 which is set for switching the print mode. Therefore, the frequency of the switching of the print mode which is caused by the variation in thicknesses of print media 40 stacked in the same paper feed tray or the measuring error of the medium thickness sensor 33 can be reduced and the print waiting time can be shortened.

The sixth embodiment of the invention will now be described above. Component elements having substantially the same structures as those in the first to fifth embodiments are designated by the same reference numerals and their description is omitted here.

Figure 11:
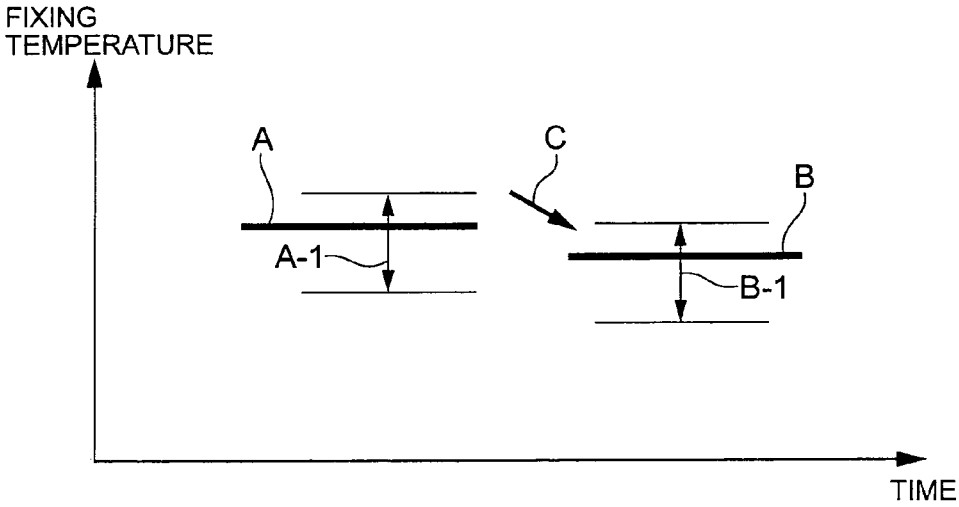
FIG. 11 is a diagram showing a fixing temperature in the sixth embodiment of the invention.

FIG. 11 is a diagram showing a fixing temperature in the sixth embodiment of the invention. An axis of abscissa indicates a time and an axis of ordinate shows the fixing temperature.

In the third embodiment mentioned above, the thickness of print medium 40 is measured every cleaning sequence and if there is a slight difference between the measured thickness and the average value of the thicknesses of print media 40 measured by the previous time, the target value of the fixing temperature is updated by the next print job. In this case, there is a possibility that although the printing is executed in the same print mode by using the same kind of print media 40 stacked in the same paper feed tray, the fixing temperature is changed each time the print job is started and the throughput deteriorates.

In other words, generally, the fixing temperature in the print standby mode is determined on the basis of the fixing temperature at the time of the previous printing as a reference, and the printable temperature range is determined on the basis of the fixing temperature in the print standby mode. Therefore, when the fixing temperature changes at the start of the printing, the printable range also changes as shown in FIG. 11, there is a fear that the surface temperature of the fixing roller is out of the printable range. FIG. 11 shows a shift of the printable range, in which "A" denotes a fixing temperature in the print standby mode after completion of the previous printing; "A-1" a printable range in the print standby mode after completion of the previous printing; "B-1" a fixing temperature updated on the basis of the thicknesses of print media 40 measured after execution of the cleaning sequence; "B-1" a printable range corresponding to the updated fixing temperature; and "C" a state where the printable range is shifted due to the updating of the fixing temperature. It will be understood from FIG. 11 that even if the same kind of print media 40 on the same paper feed tray are used and printed in the same print mode, warm-up or cool-down of the fixing device 24 occurs frequently and the waiting time becomes long.

In the fifth embodiment, when the difference between the thickness of print medium 40 measured every cleaning sequence and the average value of the thicknesses of print media 40 measured by the previous time is equal to or less than the predetermined value, the target value of the fixing temperature is not updated.

The operation of the image forming apparatus with the above construction will now be described. Since a construction of the image forming apparatus is similar to those in the first to fifth embodiments, its description is omitted.

Figure 12A:
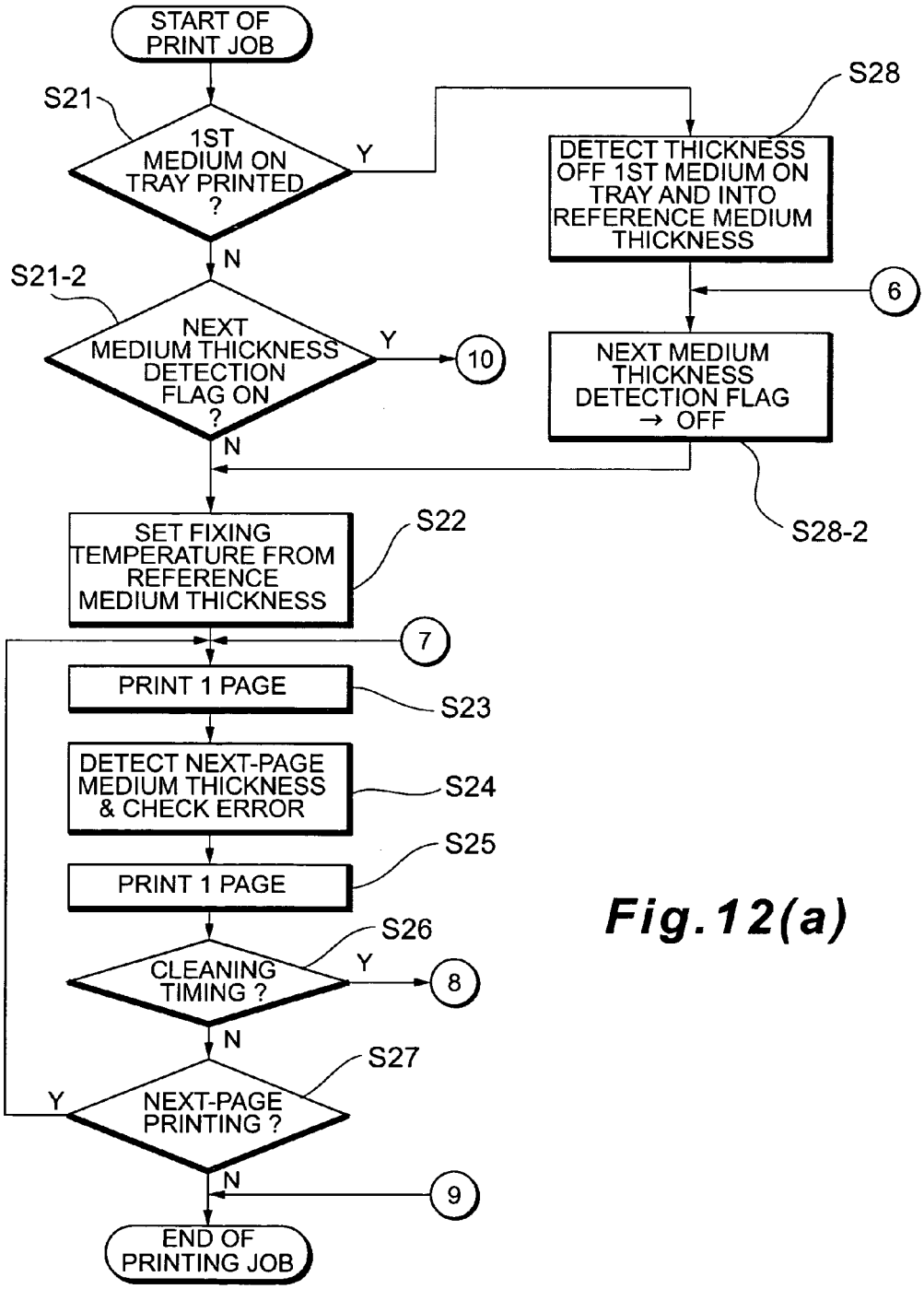
FIG. 12 is a flowchart showing the operation of an image forming apparatus in the sixth embodiment of the invention.
Figure 12B:
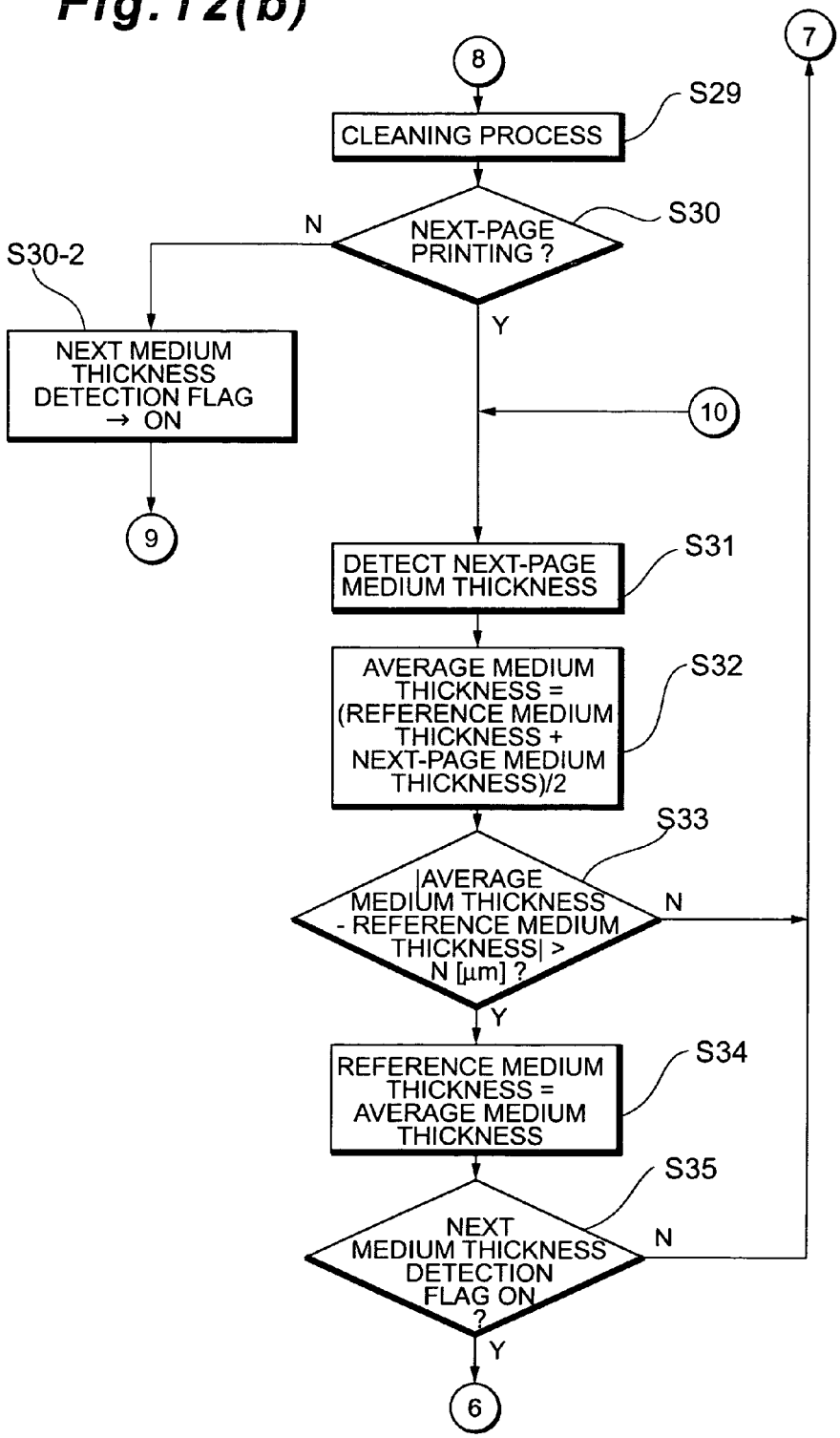

FIG. 12 is a flowchart showing the operation of the image forming apparatus in the sixth embodiment of the invention.

First, when the print job is started, whether or not the printing is the printing of the first one of the media on the paper feed tray, that is, it is the first-medium printing on the tray is discriminated. If it is not the first-medium printing, the fixing temperature is set on the basis of the standard medium thickness as a thickness of print medium 40 serving as a reference. In the case of the first-medium printing, the medium thickness sensor 33 measures the thickness of print medium 40. That is, the thickness of the first medium on the tray is detected. After the measured thickness of print medium 40 is set to the standard medium thickness, the fixing temperature is set on the basis of the standard medium thickness.

Subsequently, one print medium 40 is printed, that is, the one-page printing is executed. The thickness of the next print medium 40 is detected, that is, the next-page medium thickness is detected and the error check described in the second embodiment for discriminating the extent of errors in comparison with the first-medium thickness is executed. Subsequently, after the execution of the one-page printing, whether or not the operating timing is the timing for executing the cleaning sequence, that is, the cleaning timing is discriminated. If it is not the cleaning timing, whether or not the next print medium 40 is printed, that is, the next-page printing exists is discriminated. If the next-page printing does not exist, the print job is finished. If the next-page printing exists, the detection of the next-page medium thickness and the error check are executed again.

Whether the operating timing is the cleaning timing or not is discriminated. If it is the cleaning timing, the cleaning sequence, that is, the cleaning process is executed. Subsequently, whether the next-page printing exists or not is discriminated. If the next-page printing does not exist, the print job is finished. If the next-page printing exists, the next-page medium thickness is detected. The average medium thickness as an average value is calculated in accordance with the following equation (1).

$$\text{(Average medium thickness)}=\text{(standard medium thickness+next-page medium thickness)}/2 \quad (1)$$

Whether or not an absolute value of the difference between the average medium thickness and the standard medium thickness is larger than N [μm] is discriminated. If it is larger than N [μm], the standard medium thickness is set to the average medium thickness. If it is not larger than N [μm], the detection of the next-page medium thickness and the error check are executed again as they are.

The flowchart will now be described.

Step S21: Whether the first-medium printing on the tray is executed or not is discriminated. If the first-medium printing on the tray is executed, step S28 follows. If the first-medium printing on the tray is not executed, step S21-2 follows.

Step S21-2: Whether or not a next medium thickness detection flag is on, if it is, step S31 follows, if it is not, step S22 follows.

Step S22: The fixing temperature is set on the basis of the standard medium thickness.

Step S23: The one-page printing is executed.

Step S24: The detection of the next-page medium thickness and the error check are executed.

Step S25: The one-page printing is executed.

Step S26: Whether the operating timing is the cleaning timing or not is discriminated. If it is the cleaning timing, step S29 follows. If it is not the cleaning timing, step S27 follows.

Step S27: Whether the next-page printing exists or not is discriminated. If the next-page printing exists, the processing routine is returned to step S24. If the next-page printing does not exist, the processing routine is finished.

Step S28: The thickness of the first medium on the tray is detected and set to the standard medium thickness.

Step S28-2: The next medium thickness detection flag is set to off, then step S22 follows.

Step S29: The cleaning process is executed.

Step S30: Whether the next-page printing exists or not is discriminated. If the next-page printing exists, step S31 follows. If the next-page printing does not exist, step S30-2 follows.

Step S30-2: The next medium thickness detection flag is set to on, then the processing routine is finished.

Step S31: The thickness of the next-page medium is detected.

Step S32: The average medium thickness is calculated in accordance with the equation (1).

Step S33: Whether or not the absolute value of the difference between the average medium thickness and the standard medium thickness is larger than N [μm] is discriminated. If the absolute value of the difference between the average medium thickness and the standard medium thickness is larger than N [μm], step S34 follows. If the absolute value of the difference between the average medium thickness and the standard medium thickness is not larger than N [μm], the processing routine is returned to step S24.

Step S34: The standard medium thickness is set to the average medium thickness.

Step S35: Whether or not the next medium thickness detection flag is on, if it is, step S28-2 follows, if it is not, step S23 follows.

Since the number of updating times of the average value of the medium thicknesses which are detected every cleaning sequence decreases in the embodiment, a change in fixing temperature decreases in the printing using the same kind of print media 40 stacked on the same paper feed tray.

Therefore, the warm-up or cool-down of the fixing device does not occur frequently and the waiting time is shortened.

The seventh embodiment of the invention will now be described. Component elements having substantially the same structures as those in the first to sixth embodiments are designated by the same reference numerals and their description is omitted here.

Figure 13:
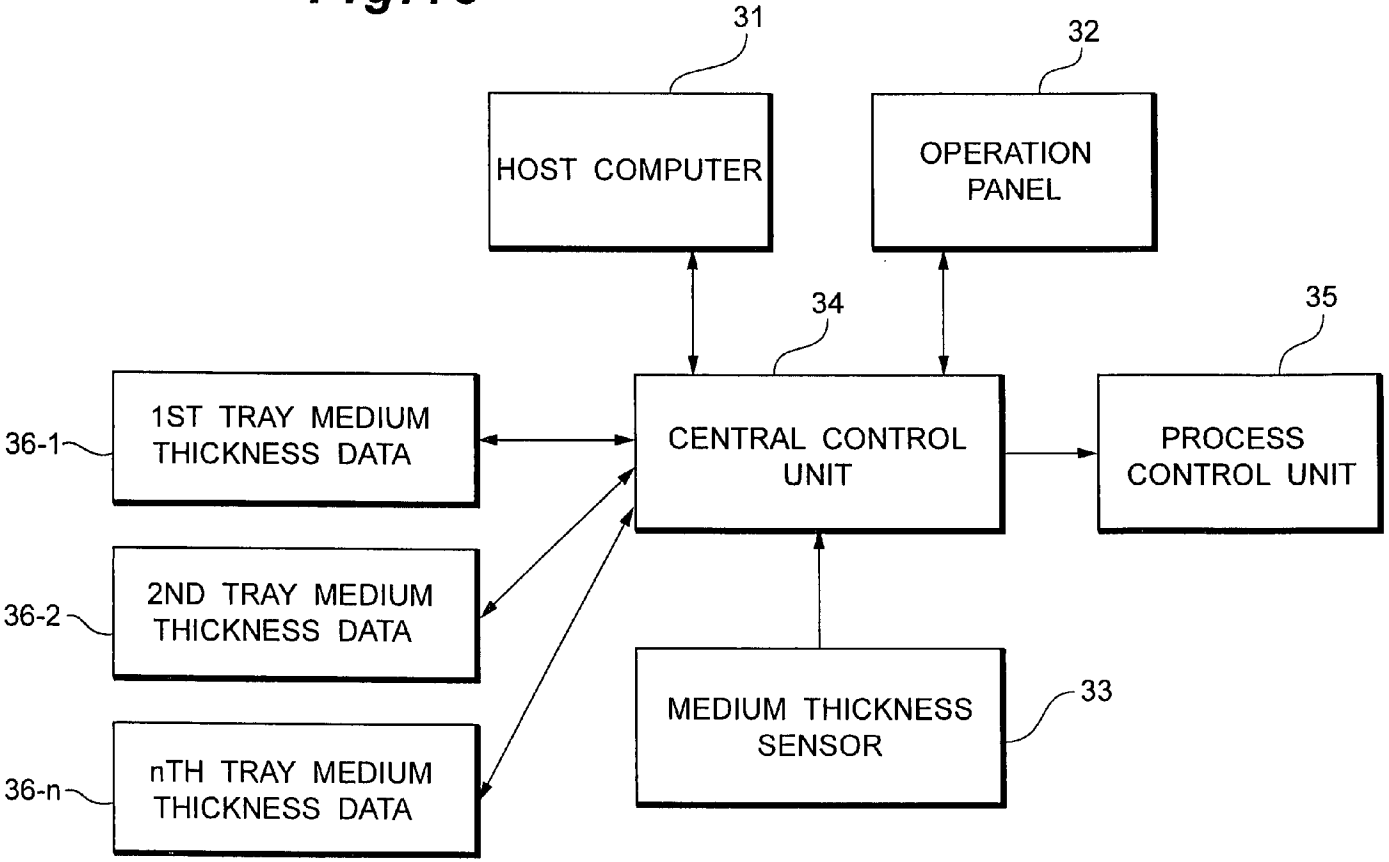
FIG. 13 is a block diagram showing a construction of a control unit in an image forming apparatus according to the seventh embodiment of the invention.

FIG. 13 is a block diagram showing a construction of a control unit in an image forming apparatus according to the seventh embodiment of the invention.

The seventh embodiment will be explained with respect to the case where the paper feed tray is a multitray. In this case, as shown in FIG. 13, the following first to nth tray medium thickness data 36-1, 36-2, . . . , and 36-n is set: that is, the first tray medium thickness data 36-1 serving as an area for storing data regarding the thicknesses of print media 40 stacked on the first paper feed tray; the second tray medium thickness data 36-2 serving as an area for storing data regarding the thicknesses of print media 40 stacked on the second paper feed tray; . . . ; and the nth tray medium thickness data 36-n serving as an area for storing data regarding the thicknesses of print media 40 stacked on the nth paper feed tray are set. "n" denotes the number of stages of the multitray and can be arbitrarily set.

The central control unit 34 sets the fixing temperature and the print speed with reference to the data of the paper feed tray to which a print request has been made. Since the tray medium thickness data 36-1 to 36-n of all of the paper feed trays have been cleared when a power source is turned on, with respect to the first print medium 40 on the paper feed tray to which the print request has been made, the thickness is measured in order to determine the fixing temperature, the print speed, and the like. Control is made with respect to the second and subsequent print media 40 in a manner similar to the foregoing first to sixth embodiments.

When a request for switching, for example, from the first paper feed tray to the second paper feed tray is received from the host computer 31, since there is no data regarding the thicknesses of print media 40 stacked on the second paper feed tray as a paper feed tray on the switching destination side, the print medium 40 is fed from the second paper feed tray and the thickness is measured in order to determine the fixing temperature, the print speed, and the like. When the request for switching from the second paper feed tray to the first paper feed tray is received again, the thickness of print medium 40 fed from the first paper feed tray is not measured but the set values are automatically switched to the values (the fixing temperature, the print speed) set when the printing is executed to the print medium 40 previously fed from the first paper feed tray.

However, if the paper feed tray is pulled out and inserted during the setting operation, there is a possibility that the kind of stacked print media 40 has been changed. Therefore, the set values before the insertion and pulling-out of the paper feed tray are once cleared and when the print request is issued, the thickness of print medium 40 is measured again.

Also with respect to the third and subsequent paper feed trays, in a manner similar to the above, unless the paper feed tray is pulled out and inserted, the thickness of only the first one of the print media 40 stacked on the paper feed tray is measured in order to decide the fixing temperature, the print speed, and the like.

Since other constructions are similar to those in the first to sixth embodiments, their description is omitted.

The operation of the image forming apparatus with the above construction will now be described. The case where the paper feed trays of two stages are attached will now be described.

First, after the power source of the image forming apparatus main body is turned on, the print request for printing the print media 40 stacked on the first paper feed tray is received from the host computer 31. The print medium 40 is fed from the first paper feed tray, the thickness is measured in order to determine the fixing temperature, the print speed, and the like, and the set values are set to the fixing temperature and the print speed suitable for printing the print media 40 on the basis of the thickness of print medium 40. When the apparatus enters the print-ready mode, the printing is started.

Subsequently, when the print request for printing the print media 40 stacked on the second paper feed tray is received from the host computer 31, the thickness of print medium 40 fed from the second paper feed tray is measured and the set values are set to the fixing temperature and the print speed suitable for printing the print media 40 on the basis of the thickness of print medium 40. When the apparatus enters the print-ready mode, the printing is started.

After the printing to the print media 40 stacked on the second paper feed tray is finished, if the print request for printing the print media 40 stacked on the first paper feed tray is received, the set values are set to the fixing temperature and the print speed suitable when the printing has been made to the print media 40 stacked on the first paper feed tray without measuring the thickness of print media 40 and the printing is started. When the first paper feed tray is pulled out and inserted again or the power source is turned on again during the setting operation, the thickness is measured in order to determine the fixing temperature, the print speed, and the like.

Subsequently, when the print request for printing the print media 40 stacked on the second paper feed tray is also received, if the tray is not pulled out and inserted again or the power source is not turned on again, the set values are set to the fixing temperature and the print speed suitable when the printing has been made to the print media 40 stacked on the second paper feed tray without measuring the thickness of print media 40 and the printing is started. This is true of the third and subsequent paper feed trays.

As mentioned above, in the seventh embodiment, when the paper feed tray is the multitray, with respect to the first print medium 40 on each paper feed tray, the thickness is measured and the set values are determined. After that, since the previous set values are used even if the paper feed tray is switched, the time for measuring the thickness of print medium 40 can be omitted and the throughput of the image forming apparatus is improved.

The eighth embodiment of the invention will now be described. Component elements having substantially the same structures as those in the first to seventh embodiments are designated by the same reference numerals and their description is omitted here.

Figure 14:
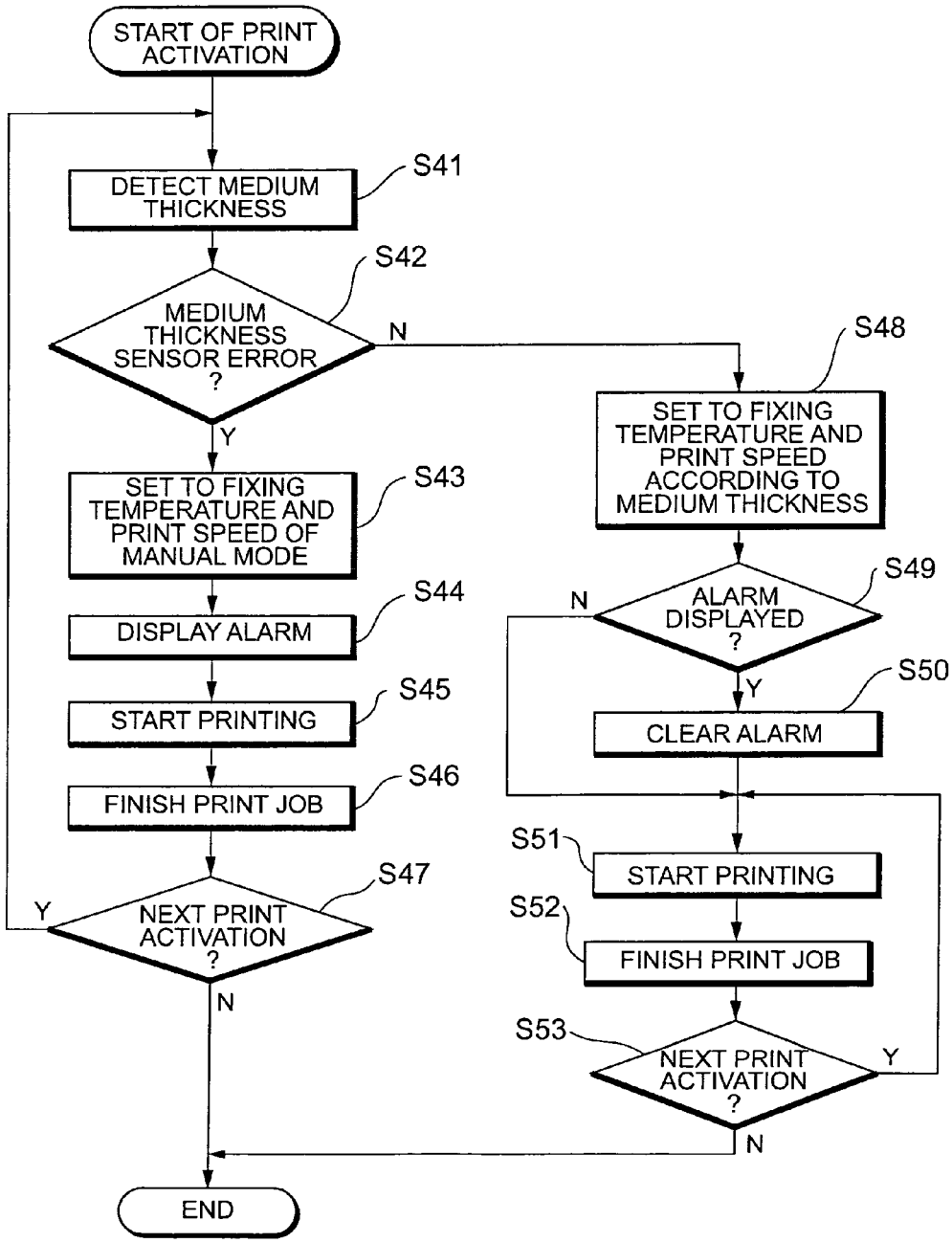
FIG. 14 is a flowchart showing the operation of an image forming apparatus in the eighth embodiment of the invention.

FIG. 14 is a flowchart showing the operation of an image forming apparatus in the eighth embodiment of the invention.

The eighth embodiment will be described with respect to the case where errors occur when the thickness of print medium 40 is measured. Ordinarily, when the thickness of print medium 40 is measured, if the output of the medium thickness sensor 33 indicates an abnormal value, the image forming apparatus is stopped soon. However, in the embodiment, the set values are set to predetermined fixing temperature and print speed and the printing is continued. The state where the output of the medium thickness sensor 33 indicates the abnormal value denotes that the value is out of a specified range or the measured thickness of print medium 40 is equal to 0 or a negative value. When the output of the medium thickness sensor 33 indicates the abnormal value, the thickness of print medium 40 which is fed from the paper feed tray is unknown. In this case, however, the set values are set to the set values suitable for the thickness of print medium 40 which is generally often used and the printing is executed.

The user can manually make media setup in accordance with the kind of print medium to be fed by operating the operation panel 32. When the output of the medium thickness sensor 33 indicates the abnormal value, the media setup is set to a medium whose thickness is equal to about 100 [μm]. The user is called his attention by a notification of an alarm. In the case of notifying the user of the alarm, the alarm is displayed to the operation panel 32 or the host computer 31 also transmits the alarm. The print job is executed at the fixing temperature and print speed which were forcedly set.

After the print job is finished, when the next print job is generated, the thickness of print medium 40 is measured in order to determine the print settings. If the thickness of print medium 40 is normally measured, the alarm is cancelled, the set values are switched to the fixing temperature and print speed based on the thickness of print medium 40, and the printing is executed. If the medium thickness sensor 33 indicates the abnormal output value again, the printing is executed in a manner similar to the foregoing case while continuously displaying the alarm.

The operation of the image forming apparatus in the eighth embodiment will now be described.

First, after the power source of the image forming apparatus main body is turned on, when the printing is activated by the host computer 31, the medium thickness sensor 33 measures the thickness of print medium 40. That is, the medium thickness is detected. Whether or not the output of the medium thickness sensor 33 indicates the abnormal value is discriminated. That is, whether the medium thickness sensor error has occurred or not is discriminated.

When the medium thickness sensor error occurs, the set values are set to the fixing temperature and print speed corresponding to the medium whose thickness is equal to about 100 [μm]. That is, they are set to the fixing temperature and print speed of the manual mode. Subsequently, the alarm is displayed on the operation panel 32, thereby calling the user's attention. When the apparatus enters the print-ready temperature, the printing is started. When the print job is finished, whether or not the print job has been received, that is, the next print activation exists is discriminated again. If the next print activation does not exist, the processing routine is finished. If the next print activation exists, the medium thickness is again detected.

Whether the medium thickness sensor error has occurred or not is discriminated. If the medium thickness sensor error does not occur, the set values are set to the fixing temperature and print speed corresponding to the medium thickness. Whether the alarm has been displayed or not is discriminated. If the alarm has been displayed, the alarm is cleared. After that, when the apparatus enters the print-ready temperature, the printing is started. When the print job is finished, whether or not the print job has been received, that is, the next print activation exists is discriminated again. If the next print activation does not exist, the processing routine is finished. If the next print activation exists, the printing is restarted.

The flowchart will now be described.

Step S41: The medium thickness is detected.

Step S42: Whether the medium thickness sensor error has occurred or not is discriminated. If the medium thickness sensor error occurs, step S43 follows. If the medium thickness sensor error does not occur, step S48 follows.

Step S43: The set values are set to the fixing temperature and print speed of the manual mode.

Step S44: The alarm is displayed.

Step S45: The printing is started.

Step S46: The print job is finished.

Step S47: Whether the next print activation exists or not is discriminated. If the next print activation exists, the processing routine is returned to step S41. If the next print activation does not exist, the processing routine is finished.

Step S48: The set values are set to the fixing temperature and print speed according to the medium thickness.

Step S49: Whether the alarm display exists or not is discriminated. If the alarm display exists, step S50 follows. If no alarm is displayed, step S51 follows.

Step S50: The alarm is cleared.

Step S51: The printing is started.

Step S52: The print job is finished.

Step S53: Whether the next print activation exists or not is discriminated. If the next print activation exists, the processing routine is returned to step S51. If the next print activation does not exist, the processing routine is finished.

As mentioned above, in the embodiment, when the output of the medium thickness sensor 33 indicates the abnormal value, the print medium 40 which is ordinarily used is presumed and the set values are set to the fixing temperature and print speed corresponding to the print medium 40. Therefore, even if the error occurs in the medium thickness sensor 33, the printing can be continued so long as the print level is equal to the ordinary print level, and working efficiency of the image forming apparatus can be improved.

Since the thickness of print medium 40 is measured again in the next print job, even if the abnormality occurs temporarily, the printing can be normally executed so long as there is no problem in the next print job.

The ninth embodiment of the invention will now be described. Component elements having substantially the same structures as those in the first to eighth embodiments are designated by the same reference numerals and their description is omitted here.

Figure 15A:
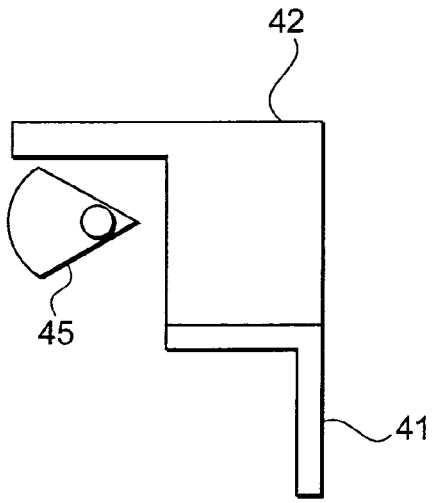
FIGS. 15A and 15B are diagrams showing a medium thickness sensor in the ninth embodiment of the invention.
Figure 15B:
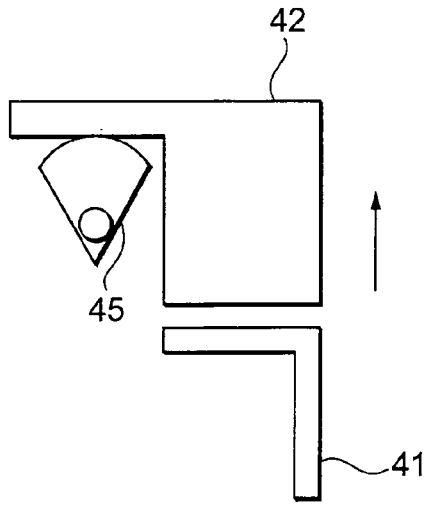

FIGS. 15A and 15B are diagrams showing a medium thickness sensor in the ninth embodiment of the invention.

In the foregoing first embodiment, the print medium 40 is always come into contact with the pickup portion 42 of the medium thickness sensor 33. Therefore, there is a case where the print medium 40 is scratched by the contact with the pickup portion 42 or a paper jam occurs. There is also a possibility that since the pickup portion 42 is come into contact with the print medium 40, the pickup portion 42 is abraded and the measuring precision of the medium thickness sensor 33 deteriorates.

In the ninth embodiment, therefore, when the thickness of print medium 40 is not measured, the pickup portion 42 is moved upward so as to be floated over the plate stage 41, thereby enabling the print medium 40 to be smoothly conveyed.

In this case, as shown in FIGS. 15A and 15B, a cam 45 which is driven by a driving apparatus (not shown) and switches the position of the pickup portion 42 is arranged. When the printing is activated, the cam 45 is rotated. When an angle of the cam 45 is as shown in FIG. 15A, a lower surface of the pickup portion 42 is come into contact with an upper surface of the plate stage 41. Thus, the pickup portion 42 is pushed upward by the print medium 40 which passes between the lower surface of the pickup portion 42 and the upper surface of the plate stage 41 and the thickness of print medium 40 can be measured as described in the first embodiment.

If there is no need to measure the thickness of print medium 40 like a case where the user selects and determines the media setting, the cam 45 is rotated to an angle as shown in FIG. 15B. Thus, the pickup portion 42 is moved upward as shown by an arrow and a large gap is formed between the lower surface of the pickup portion 42 and the upper surface of the plate stage 41. Therefore, the print medium 40 can pass through the gap without being come into contact with the pickup portion 42.

As mentioned above, in the embodiment, when there is no need to measure the thickness of print medium 40, the pickup portion 42 is moved upward and floated from the plate stage 41, thereby enabling the print medium 40 to be smoothly conveyed. Thus, the print medium 40 is not scratched or no paper jam occurs. The pickup portion 42 is not abraded and the measuring precision of the medium thickness sensor 33 does not deteriorate.

The invention is not limited to the foregoing embodiments but many modifications and variations are possible on the basis of the spirit of the invention and they are not excluded from the scope of the invention.

What is claimed is:

1. A fixing temperature control method in an image forming apparatus which has medium thickness detecting means for detecting a thickness of print medium and forms an image by an electrophotographic process, comprising the steps of:

detecting the thickness of said print medium that is used after a predetermined operation and detecting thicknesses of print media at a predetermined interval set for printing a plurality of said print media, and setting a target temperature of a fixing device on the basis of the thickness of said print medium that is used after said predetermined operation and the thicknesses of said print media detected at said predetermined interval set for printing a plurality of said print media.

2. The method according to claim 1, wherein said predetermined operation is an operation to attach a paper feed tray to said image forming apparatus.

3. The method according to claim 1, wherein in said image forming apparatus having a plurality of paper feed trays, said predetermined operation is an operation to change said paper feed trays which are used.

4. The method according to claim 1, wherein said predetermined interval set for printing said plurality of said print media is set on the basis of the number of print pages.

5. The method according to claim 1, wherein said predetermined interval is set on the basis of the number of rotations of a photosensitive drum.

6. The method according to claim 1, wherein a setting of said predetermined interval set for printing said plurality of said print media can be changed.

7. The method according to claim 1, wherein said step of setting said target temperature of said fixing device comprises setting said target temperature in accordance with an average value of the detected thickness of the print medium and the previously detected thickness of the print medium.

8. The method according to claim 1, further comprising the steps of:

detecting the thickness of said print medium every page, and;

ejecting said print medium without forming the image when a difference between the thickness of said print medium detected every page and the thickness of said print medium serving as a reference upon setting of the fixing temperature is equal to or larger than a predetermined value.

9. The method according to claim 1, wherein the target temperature of said fixing device is not changed until a print job is finished.

10. The method according to claim 1, wherein the target temperature of said fixing device is set on the basis of the detected thicknesses of a plurality of print media.

11. The method according to claim 10, wherein the target temperature of said fixing device is set by majority decision of ranks of the detected thicknesses of a plurality of print media.

12. The method according to claim 10, wherein the target temperature of said fixing device is set on the basis of an average value of the detected thicknesses of a plurality of print media.

13. The method according to claim 1, wherein a threshold value of the thickness of said print medium which is used for switching the target temperature of said fixing device to a low temperature and a threshold value of the thickness of said print medium which is used for switching the target temperature of said fixing device to a high temperature are different.

14. The method according to claim 1, wherein:

an average value of the thickness of said print medium serving as a reference upon setting of the fixing temperature and the detected thickness of said print medium is calculated;

when a difference between said average value and the thickness of said print medium serving as a reference upon setting of the fixing temperature exceeds a predetermined value, the thickness of said print medium serving as a reference upon setting of the fixing temperature is updated by said average value; and the target temperature of said fixing device in a next print job is set on the basis of the updated thickness of said print medium serving as a reference upon setting of the fixing temperature.

15. The method according to claim 1, wherein:

said image forming apparatus further has a plurality of paper feed trays and means which detects the thickness of the first print medium after the print media were set onto each of said paper feed trays and stores the detected thickness; and the target temperature of said fixing device is set on the basis of the thickness of said print medium stored for every paper feed tray in subsequent printing.

16. The method according to claim 1, wherein when a detection value of the thickness of said print medium is out of a predetermined range, the target temperature of said fixing device is set on the basis of a preset initial value of the print medium thickness.

17. An image forming apparatus for forming an image by an electrophotographic process, comprising:

a medium thickness detecting section for detecting a thickness of print medium, which detects a thickness of said print medium that is used after a predetermined operation, and detects a thickness of said print medium at a predetermined interval set for printing a plurality of said print media;

a fixing device; and a target temperature setting section which sets a target temperature of said fixing device on the basis of the thickness obtained after said predetermined operation and the thickness obtained at said predetermined interval set for printing a plurality of said print media.

18. The apparatus according to claim 17, wherein a cleaning process is executed at a time other than an image forming period of time, and said target temperature setting section sets the target temperature of said fixing device during which said cleaning process is executed.

19. An image forming apparatus for forming an image by an electrophotographic process, comprising:

a medium character detecting section for detecting a character of print medium, which detects a character of said print medium that is used after a predetermined operation, and detects a character of said print medium at a predetermined interval set for printing a plurality of said print media;

a fixing device; and a target temperature setting section which sets a target temperature of said fixing device on the basis of the character obtained after said predetermined operation and the character obtained at said predetermined interval set for printing a plurality of said print media.

* * * * *